US008916319B2

(12) United States Patent
Ikeda et al.

(10) Patent No.: US 8,916,319 B2
(45) Date of Patent: Dec. 23, 2014

(54) TONER

(71) Applicant: Canon Kabushiki Kaisha, Tokyo (JP)

(72) Inventors: Naotaka Ikeda, Suntou-gun (JP); Takayuki Toyoda, Yokohama (JP); Masashi Kawamura, Yokohama (JP); Hidekazu Fumita, Gotemba (JP); Emi Watanabe, Suntou-gun (JP); Yasuhiro Hashimoto, Mishima (JP); Yuhei Terui, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/777,990

(22) Filed: Feb. 26, 2013

(65) Prior Publication Data

US 2013/0224647 A1 Aug. 29, 2013

(30) Foreign Application Priority Data

Feb. 29, 2012 (JP) ..... 2012-044320

(51) Int. Cl.

| | |
|---|---|
| ***G03G 9/09*** | (2006.01) |
| ***G03G 9/097*** | (2006.01) |
| ***G03G 9/087*** | (2006.01) |
| ***G03G 9/08*** | (2006.01) |

(52) U.S. Cl.

CPC ..... *G03G 9/08* (2013.01); *G03G 9/08791* (2013.01); *G03G 9/08722* (2013.01); *G03G 9/091* (2013.01); *G03G 9/08728* (2013.01); *G03G 9/08708* (2013.01); *G03G 9/0806* (2013.01); *G03G 9/08711* (2013.01)

USPC ..... 430/108.22; 430/108.23

(58) Field of Classification Search

USPC ..... 430/108.22, 108.23, 108.5

See application file for complete search history.

(56) References Cited

U.S. PATENT DOCUMENTS

| | | | |
|---|---|---|---|
| 5,601,913 | A | 2/1997 | Ohtani et al. |
| 6,627,374 | B2 | 9/2003 | Fumita et al. |
| 6,835,521 | B2 | 12/2004 | Tsuji et al. |
| 6,936,394 | B2 | 8/2005 | Okado et al. |
| 6,951,704 | B2 | 10/2005 | Tsuji et al. |
| 7,112,393 | B2 | 9/2006 | Komoto et al. |
| 7,141,342 | B2 | 11/2006 | Toyoda et al. |
| 7,264,910 | B2 | 9/2007 | Toyoda et al. |
| 7,288,357 | B2 | 10/2007 | Toyoda et al. |
| 7,459,253 | B2 | 12/2008 | Abe et al. |
| 7,611,816 | B2 | 11/2009 | Tuji et al. |
| 7,704,661 | B2 | 4/2010 | Ikeda et al. |
| 7,833,685 | B2 | 11/2010 | Tanaka et al. |
| 7,833,687 | B2 | 11/2010 | Kato et al. |
| 8,053,156 | B2 | 11/2011 | Abe et al. |
| 8,211,606 | B2 | 7/2012 | Murai et al. |
| 8,247,147 | B2 | 8/2012 | Abe et al. |
| 8,367,289 | B2 | 2/2013 | Isono et al. |
| 8,377,616 | B2 | 2/2013 | Tani et al. |
| 8,440,382 | B2 | 5/2013 | Isono et al. |
| 2005/0048393 | A1 | 3/2005 | Ota |
| 2009/0130582 | A1 | 5/2009 | Handa et al. |
| 2009/0226840 | A1 | 9/2009 | Fumita et al. |
| 2010/0291482 | A1* | 11/2010 | Minami et al. ..... 430/108.5 |
| 2011/0097660 | A1 | 4/2011 | Sugiyama et al. |
| 2011/0136054 | A1 | 6/2011 | Watanabe et al. |
| 2012/0040285 | A1 | 2/2012 | Shibata et al. |
| 2012/0231388 | A1 | 9/2012 | Kawamura et al. |
| 2012/0315574 | A1 | 12/2012 | Nonaka et al. |
| 2013/0095421 | A1 | 4/2013 | Tanaka et al. |
| 2013/0244165 | A1 | 9/2013 | Hashimoto et al. |

FOREIGN PATENT DOCUMENTS

| | | | |
|---|---|---|---|
| JP | 11-119461 | A | 4/1999 |
| JP | 2005-77729 | A | 3/2005 |
| JP | 2010-152208 | A | 7/2010 |

* cited by examiner

*Primary Examiner* — Janis L Dote

(74) *Attorney, Agent, or Firm* — Fitzpatrick, Cella, Harper and Scinto

(57) ABSTRACT

Provided is a toner manufactured in an aqueous solvent, whereby a satisfactory image density can be obtained and the toner laid-on level on a recording medium can be reduced with a normal added concentration of pigment without adding a large quantity of pigment to the toner. The toner is manufactured in an aqueous medium by the suspension polymerization or dissolution suspension method and contains a binder resin, a pigment and an azo compound. The azo compound is a specific azo compound, and the absolute value of the difference in zeta potential between the binder resin and the azo compound is 25 mV or less.

12 Claims, No Drawings

TONER

BACKGROUND OF THE INVENTION

1. Field of the Invention

The present invention relates to a toner for electrostatic image development, to be used for image formation in a copier, printer or other electrophotographic system.

2. Description of the Related Art

In image forming methods using electrophotographic systems in general, an electrostatic latent image is formed on a photosensitive member, the electrostatic latent image is then developed with a toner, and the resulting toner image is transferred either directly or indirectly as necessary to a transfer paper or other recording medium and fixed to obtain a visible image.

In recent years there has been increasing demand for higher printing speeds and greater resolution and image quality in printers and the like, and attempts have been made in the field to achieve greater image quality by reducing the size of the toner particles. This is particularly notable in the case of color toner, and toner particle sizes are being made smaller and smaller due to the appearance of toners prepared not only by dry methods, but also by wet methods such as the suspension polymerization method, agglomerated particle method and dissolution suspension method.

From an environmental perspective, on the other hand, printers and the like are subject to demands for energy savings. Reducing the fixing energy is especially important, and as a countermeasure for this, methods of reducing the toner laid-on level on the recording medium are being actively studied. Increasing the tinting strength of the toner is key to achieving this.

The tinting strength of the toner can be increased by increasing the added amount of the coloring agent or improving the dispersibility of the coloring agent in the toner, but coloring agents are normally expensive, so the problem with the first method is that it may increase the raw material cost of the toner. If a large amount of coloring agent is added, moreover, the intrinsic charging performance and polarity of the coloring agent are more likely to affect the toner, adversely affecting the charging performance of the toner, and detracting from the granulating properties in some cases in the case of toners formed by wet methods. There has therefore been much research into improving the dispersibility of the coloring agent in the toner, and for example a method has been proposed for surface treating the pigment (Japanese Patent Application laid-open No. H11-119461).

However, there is room for improvement in the dispersibility of the pigment in the toner. In the case of toner particles that are polymerized in an aqueous medium, moreover, the pigment can become overconcentrated on the surface of the toner particles due to the presence of polar groups on the pigment surface, detracting from the charging performance and stress resistance.

To improve the tinting strength of the toner, it is necessary first and foremost to pulverize the pigment as finely as possible, and disperse it uniformly in a binder resin. To this end, in the case of toner particles obtained by suspension polymerization for example, the pigment must be uniformly and finely dispersed in a polymerizable monomer before being polymerized.

However, in the case of toner particles obtained by the suspension polymerization method or dissolution suspension method, it is difficult to achieve uniform and fine dispersion of the pigment because there is no step of uniformly mixing a toner material with strong shearing force using a highly viscous medium, as when melt-mixing toner obtained by a pulverization method.

Therefore, a method using various kinds of media dispersers has been proposed as a method of disposing a pigment in a polymerizable monomer (Japanese Patent laid-open No. 2005-77729).

However, even if the pigment is uniformly dispersed in a polymerizable monomer using various kinds of dispersers before the granulating step, dispersion of the pigment particles in the liquid is not stable, and it is often the case that the pigment re-aggregates during the granulating step or reaction step, or becomes overconcentrated at the boundary between the water and the toner particle oil droplets. On the other hand, if the pigment is insufficiently dispersed in the polymerizable monomer composition, it is difficult to form uniform liquid drops of the polymerizable monomer composition in the aqueous medium, and in some cases the particle distribution of the toner particles may become too broad, the image density of the resulting toner may be reduced, and the resolution may be seriously affected.

Another problem has been that the charging performance and stress resistance of the toner declines when the pigment is overconcentrated on the surface of the toner particles.

As a method of addressing these problems, the use of various pigment dispersants has been studied for improving the dispersibility of the pigment in the toner (Japanese Patent laid-open No. 2010-152208). Although the dispersibility of the pigment can be temporarily increased by this means, this is not sufficient to stabilize dispersion in a polymerizable monomer or other liquid. In particular, when toner particles are manufactured by the suspension polymerization method or dissolution suspension method, stress resistance and charging performance are often achieved by forming a shell layer with a polar resin on the surface of the particles. In this case, the pigment dispersant may act on the polar resin rather than on the pigment in the dispersion step, granulation step or reaction step, so that the desired effect on dispersion of the pigment is not obtained. This may also result in insufficient shell layer formation on the toner, making it difficult to closely control the charging performance of the toner. The stress resistance of the toner may also be adversely affected, so that a stable high image quality cannot be maintained during long-term use.

In all of these methods, it has been difficult to disperse the pigment in the toner and obtain a toner with improved tinting strength without adversely affecting the manufacturing stability, charging performance and stress resistance of the toner when manufacturing a toner by the suspension polymerization method or dissolution suspension method.

SUMMARY OF THE INVENTION

The aim of the present invention is to resolve the aforementioned problems of prior art and achieve the following objects.

That is, it is an object of the present invention to provide a toner whereby a satisfactory image density can be obtained and the toner laid-on level on the recording medium can be reduced in a toner manufactured by the suspension polymerization method or dissolution suspension method (hereunder abbreviated as a toner manufactured in an aqueous medium) with a normal added concentration of pigment without adding a large quantity of pigment to the toner. In achieving this, it is another object to provide a toner whereby high resolution and high image quality can be obtained over a long period of time without causing problems with the manufacturing stability, charging performance or stress resistance of the toner.

These objects are achieved by means of the following inventions.

That is, the present invention is a toner comprising toner particles, each of which contains a binder resin, a pigment and an azo compound and manufactured in an aqueous medium by the manufacturing method of (i) or (ii) below:

(i) dispersing and granulating a polymerizable monomer composition containing a polymerizable monomer, a pigment and an azo compound in an aqueous medium, and polymerizing the polymerizable monomer contained in granulated particles to thereby produce a toner;

(ii) dissolving or dispersing a toner composition containing a binder resin, a pigment and an azo compound in an organic solvent, dispersing and granulating the resulting mixed solution in an aqueous medium, and removing the organic solvent contained in granulated particles to thereby produce a toner, wherein the azo compound contains a polymer component, and the part other than the polymer component is represented by General Formula (1) below:

[C 1]

Formula (1)

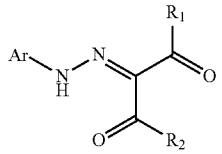

(in Formula (1), any one of $R_1$, $R_2$ and Ar is bound to the polymer component with a single bond or linking group; $R_1$ not bound to the polymer component represents a monovalent group selected from the group consisting of an alkyl group, phenyl group, $OR_5$ group and $NR_6R_7$ group wherein $R_5$ to $R_7$ each independently represent a hydrogen atom, alkyl group, phenyl group or aralkyl group, $R_8$, which is bound to the polymer component with a single bond or a linking group, represents a divalent group of which a hydrogen atom is removed from the corresponding monovalent group of $R_1$, and the divalent linking group is selected from the group consisting of an amide group, an ester group, a urethane group, a urea group, an alkylene group, a phenylene group, —O—, —$NR_3$— and —$NHCH(CH_2OH)CH_2$— wherein $R_3$ represents a hydrogen atom, alkyl group, phenyl group or aralkyl group); $R_2$ not bound to the polymer component represents a monovalent group selected from the group consisting of an alkyl group, phenyl group, and $NR_{10}R_{11}$ group wherein $R_{10}$ and $R_{11}$ each independently represent a hydrogen atom, alkyl group, phenyl group or aralkyl group, $R_2$, which is bound to the polymer component with a single bond or a linking group, represents a divalent of which a hydrogen atom is removed from the corresponding monovalent group of $R_2$, and the linking group is divalent group selected from the group consisting of an alkylene group, a phenylene group, —O—, —$NR_8$—, —$NHCOC(CH_2)_2$— and —$NHCH(CH_2OH)CH_2$— wherein $R_8$ represents a hydrogen atom, alkyl group, phenyl group or aralkyl group; Ar not bound to the polymer component represents an aryl group, Ar, which is bound to the polymer component with a single bond or a linking group, represents a divalent group of which a hydrogen atom is removed from the corresponding aryl group, and the linking group is a divalent linking group selected from the group consisting of an amide group, an ester group, a urethane group, a urea group, an alkylene group, a phenylene group, —O—, —$NR_3$— and —$NHCH(CH_2OH)CH_2$— wherein $R_3$ represents a hydrogen atom, alkyl group, phenyl group or aralkyl group and the absolute value of the difference in zeta potential between the binder resin and the azo compound is 25 mV or less.

With the toner of the present invention, the toner laid-on level on the recording medium can be reduced and adequate image density can be obtained with a normal added concentration of pigment without adding a large quantity of pigment to the toner in a toner manufactured in an aqueous medium. In achieving this, moreover the toner of the present invention provides stable, long-term high resolution and high picture quality without causing problems of toner manufacturing stability, charging performance or stress resistance.

Further features of the present invention will become apparent from the following description of exemplary embodiments.

DESCRIPTION OF THE EMBODIMENTS

The inventors discovered as a result of exhaustive research into the structure and physical properties of pigment dispersants that a toner that resolves these problems could be obtained with a toner manufactured in an aqueous medium.

That is, the toner of the present invention comprises toner particles, each of which contains a binder resin, a pigment and an azo compound, and is manufactured in an aqueous medium by the manufacturing method of (i) or (ii) below:

(i) dispersing and granulating a polymerizable monomer composition containing a polymerizable monomer, a pigment and an azo compound in an aqueous medium, and polymerizing the polymerizable monomer contained in granulated particles to thereby produce a toner (suspension polymerization method);

(ii) dissolving or dispersing a toner composition containing a binder resin, a pigment and an azo compound in an organic solvent, dispersing and granulating the resulting mixed solution in an aqueous medium, and removing the organic solvent contained in granulated particles to thereby produce a toner (dissolution suspension method), wherein the azo compound contains a polymer component, and the part other than the polymer component is represented by General Formula (1) below:

[C 2]

Formula (1)

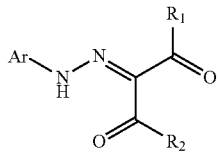

(in Formula (1), any one of $R_1$, $R_2$ and Ar is bound to the polymer component with a single bond or linking group; $R_1$ not bound to the polymer component represents a monovalent group selected from the group consisting of an alkyl group, phenyl group, $OR_5$ group and $NR_6R_7$ group wherein $R_5$ to $R_7$ each independently represent a hydrogen atom, alkyl group, phenyl group or aralkyl group, $R_1$, which is bound to the polymer component with a single bond or a linking group, represents a divalent group of which a hydrogen atom is removed from the corresponding monovalent group of $R_1$, and the divalent linking group is selected from the group consisting of an amide group, an ester group, a urethane group, a urea group, an alkylene group, a phenylene group, —O—, —$NR_3$— and —$NHCH(CH_2OH)CH_2$— wherein $R_3$ represents a hydrogen atom, alkyl group, phenyl group or aralkyl group); $R_2$ not bound to the polymer component represents a monovalent group selected from the group consisting of an alkyl group, phenyl group, and $NR_{10}R_{11}$ group wherein $R_{10}$ and $R_{11}$ each independently represent a hydrogen atom, alkyl group, phenyl group or aralkyl group, $R_2$, which is bound to the polymer component with a single bond or a linking group, represents a divalent of which a hydrogen atom is removed from the corresponding monovalent group of $R_2$, and thelinking group is divalent group selected from the group consisting of an alkylene group, a phenylene group, —O—, —$NR_8$—, —$NHCOC(CH_3)_2$— and —$NHCH(CH_2OH)CH_2$— wherein $R_8$ represents a hydrogen atom, alkyl group, phenyl group or aralkyl group; Ar not bound to the polymer component represents an aryl group, Ar, which is bound to the polymer component with a single bond or a linking group, represents a divalent group of which a hydrogen atom is removed from the corresponding aryl group, and the linking group is a divalent linking group selected from the group consisting of an amide group, an ester group, a urethane group, a urea group, an alkylene group, a phenylene group, —O—, —$NR_3$— and —$NHCH(CH_2OH)CH_2$— wherein $R_3$ represents a hydrogen atom, alkyl group, phenyl group or aralkyl group and the absolute value of the difference in zeta potential between the binder resin and the azo compound is 25 mV or less.

The azo compound in the present invention is composed of the partial structure having high adsorbability by the pigment (hereunder abbreviated as the azo skeleton partial structure), which excludes the polymer component of Formula (1) above, together with a polymer component having high affinity for the binder resin and dispersion medium and also having an enhanced steric repulsion effect to suppress aggregation of pigment particles, as well as a linking part for binding the polymer component to the azo skeleton partial structure.

In the present invention, a binder resin means a resin that forms the core of the toner particles (excluding the resin forming the shell).

In the present invention, the absolute value of the difference in zeta potential between the binder resin of the toner and the azo compound is 25 mV or less, or preferably 0 mV or more, or more preferably 18 mV or less. Within this range, even if there is a large zeta potential difference between the binder resin and the pigment used, it is possible to maintain a small zeta potential difference between the binder resin and the pigment with the adsorbed azo compound when the azo compound is adsorbed on the pigment. This increases the affinity of the pigment for the binder resin, thereby improving the dispersibility of the pigment in the binder resin. If the absolute value of the zeta potential difference is greater than 25 mV, the pigment with the adsorbed azo compound will have less affinity for the binder resin. As a result, the pigment may aggregate during the granulation and reaction steps during toner manufacture, resulting in overconcentration of the pigment at the boundary between the water and the toner oil droplets, which adversely affects the particle size distribution of the toner and detracts from the charging performance.

The zeta potential of the azo compound of the present invention is preferably at least −10 mV but no more than 12 mV, or more preferably at least −5 mV but no more than 5 mV.

The zeta potential of the binder resin of the toner and the zeta potential of the azo compound can both be adjusted appropriately by adjusting the type and number of functional groups.

For example, the zeta potential in the binder resin or azo compound can be reduced if there is a large number or variety of carboxyl groups and other acidic functional groups. On the other hand, the zeta potential can be increased if there is a large number or variety of amino groups and other basic functional groups. The absolute value of the difference in zeta potential can be adjusted appropriately within the aforementioned range by adjusting the kinds and numbers of these functional groups in the binder resin and azo compound as necessary.

In the present invention, an adsorption rate of the azo compound by the pigment is preferably 30% or more, or more preferably 70% or more. The adsorption rate can be controlled within this range by appropriately selecting the aforementioned azo skeleton partial structure.

If the adsorption rate and the zeta potential of the azo compound are within the aforementioned ranges, the pigment is easier to disperse in the binder resin, and the manufacturing stability, charging performance and stress resistance of the toner are less likely to be adversely affected. When the adsorption rate is less than 30%, it may be necessary to add more of the pigment relative to the azo compound. When the adsorption rate is less than 30% or when the zeta potential of the azo compound is outside the aforementioned range, moreover, azo compound not adsorbed by the pigment may become overconcentrated at the boundary between the water and the toner oil droplets when manufacturing toner particles in an aqueous solvent, potentially affecting the particle size distribution of the toner. It may also detract from the charging performance of the toner by acting on charge control agents, polar resins and the like that are added as necessary. It may also cause incomplete shell layer formation, thereby reducing the stress resistance of the toner.

In the present invention, the acid value of the azo compound is preferably 30 mgKOH/g or less, or more preferably 10 mgKOH/g or less. Within this range, there is less risk of adverse effects on the manufacturing stability of the toner, and the pigment is easier to disperse in the binder resin. If the acid value of the binder resin is greater than 30 mgKOH/g, the azo compound may interact with a dispersion stabilizer used in the aqueous solvent when manufacturing the toner particles by the suspension polymerization method for example, interfering with the granulating properties of the toner. The acid value of the azo compound is preferably at least 0 mgKOH/g.

The azo compound of the present invention is explained in detail below.

The structure of the azo compound of the present invention must be designed so that the absolute value of the difference in zeta potential with the binder resin is within the aforementioned range. It is also preferably designed so that the adsorption rate of the azo compound on the pigment and the zeta potential and acid value of the azo compound are within the aforementioned ranges.

First, the azo skeleton partial structure represented by Formula (1) above is explained in detail.

In Formula (1) above, any of $R_1$, $R_2$ and Ar is bound to the polymer component with a single bond or a linking group.

$R_1$ not bound to the polymer component represents a monovalent group selected from the group consisting of an alkyl group, phenyl group, $OR_5$ group or $NR_6R_7$ group wherein $R_5$ to $R_7$ each independently represent a hydrogen atom, alkyl group, phenyl group or aralkyl group, and $R_1$, which is bound to the polymer component with single bond or linking group, represents a divalent group of which a hydrogen atom is removed from the corresponding monovalent group of $R_1$, and a linking group that is bound to to $R_1$ is a divalent linking group selected from the group consisting of an amide group, an ester group, a urethane group, a urea group, an alkylene group, a phenylene group, —O—, —$NR_3$— and —$NHCH(CH_2OH)CH_2$— wherein $R_3$ represents a hydrogen atom, alkyl group, phenyl group or aralkyl group. $R_2$ not bound to the polymer component represents a monovalent group selected from the group consisting of an alkyl group, phenyl group, or $NR_{10}R_{11}$ group, wherein $R_{10}$ and $R_{11}$ each independently represent a hydrogen atom, alkyl group, phenyl group or aralkyl group, and $R_2$, which is bound to the polymer component with a single bond or a linking group, represents a divalent group of which a hydrogen atom is removed from the corresponding monovalent group of $R_2$, and the linking group that is bound to $R_2$ is a divalent linking group selected from the group consisting of an alkylene group, a phenylene group, —O—, —$NR_8$—, —NHCOC$(CH_3)_2$— and —NHCH($CH_2OH$)$CH_2$—, wherein $R_8$ represents a hydrogen atom, alkyl group, phenyl group or aralkyl group.

Ar not bound to the polymer component represents an aryl group, Ar, which is bound to the polymer component with a single bond or a linking group, represents a divalent group of which a hydrogen atom is removed from the corresponding aryl groupand the linking group that is bound to Ar is a divalent linking group selected from the group consisting of an amide group, an ester group, a urethane group, a urea group, an alkylene group, a phenylene group, —O—, —$NR_3$— and —NHCH($CH_2OH$)$CH_2$—, wherein $R_3$ represents a hydrogen atom, alkyl group, phenyl group or aralkyl group.

When the aforementioned single bond or linking group is bound to $R_1$, $R_2$ or Ar, it is bound by substitution for a hydrogen atom of $R_1$, $R_2$ or Ar.

Because the azo skeleton partial structure is an azo structure in the azo compound, it confers good adsorbability by azo pigments.

In the present invention, examples of alkyl groups in $R_1$ and $R_2$ of Formula (1) above include methyl, ethyl, n-propyl, n-butyl, n-pentyl, n-hexyl, isopropyl, isobutyl, sec-butyl, tert-butyl, cyclohexyl and other linear, branched and cyclic alkyl groups.

Examples of the alkyl groups at $R_5$ to $R_7$ in Formula (1) above include methyl, ethyl, n-propyl, n-butyl, n-pentyl, n-hexyl, isopropyl, isobutyl, sec-butyl, tert-butyl, cyclohexyl and other linear, branched and cyclic alkyl groups.

Examples of aralkyl groups in $R_1$ and $R_2$ of Formula (1) above include benzyl and phenethyl groups and the like.

From the standpoint of adsorbability by the pigment in the present invention, desirable examples of $R_1$ are $C_{1-6}$ alkyl, phenyl, $NH_2$, $OCH_3$ or $OCH_3C_6H_5$ groups. When $R_1$ is bound to the polymer component, it is bound with a single bond or a linking group, and desirable examples of the linking group are divalent linking groups selected from the group consisting of an amide group, an ester group, a urethane group, a urea group, an alkylene group, a phenylene group, —O—, —NH— and —NHCH($CH_2OH$)$CH_2$—.

When the aforementioned single bond or linking group is bound to $R_1$, it binds by substitution for a hydrogen atom of R.

The substituent of $R_1$ in Formula (1) above may also itself be substituted with another substituent to the extent that this does not greatly detract from adsorbability by the pigment. In this case, examples of substituents that can be substituted include halogen atoms and nitro, amino, hydroxyl, cyano and trifluoromethyl groups and the like.

$R_2$ in Formula (1) above can be selected at will from a hydrogen atom and the substituents given as examples above. Of these, $R_2$ is preferably $NR_{10}R_{11}$, wherein $R_{10}$ is a hydrogen atom and $R_{11}$ is a $C_{1-6}$ alkyl or phenyl group so that the azo skeleton partial structure improves adsorbability by means of π-π interactions with pigments such as carbon black, copper phthalocyanine, quinacridone and carmine having large π conjugate planes.

When $R_2$ is bound to the polymer component, it is bound with a single bond or linking group. Desirable examples of linking groups bound to $R_2$ are divalent linking groups selected from the group consisting of an alkylene group, a phenylene group, —O—, —NH—, —NHCOC$(CH_3)_2$— and —NHCH($CH_2OH$)$CH_2$—.

When $R_2$ is bound to the polymer component, moreover, an example of a preferred embodiment is one in which $R_2$ is $NR_{10}R_{11}$, with $R_{10}$ being a hydrogen atom and $R_{11}$ being a phenyl group of which a hydrogen atom is removed, and with this phenyl group being bound to the polymer component with a divalent linking group. In a preferred embodiment, this linking group is —NH— or —NHCOC$(CH_3)_2$—. When this linking group is bound to $R_2$, it is bound by substitution for a hydrogen atom of $R_2$.

Ar in Formula (1) above represents an aryl group, such as a phenyl group or naphthyl group. In the azo compound of the present invention, adsorbability by pigments having large π conjugate planes can be improved by providing an Ar structure in Formula (1) above.

Ar in Formula (1) above may be further substituted with another substituent in order that the azo skeleton partial structure does not greatly inhibit adsorbability by means of π-π interactions with pigments having large π conjugate planes, and in order to improve adsorbability with the pigment by hydrogen bonding.

Examples of substituents that can be substituted in Ar include alkyl groups, alkoxy groups, halogen atoms and hydroxyl, cyano, trifluoromethyl, carboxyl, carboxylic ester and carboxylic amide groups and the like. These substituents are preferably selected appropriately so as to form and reinforce hydrogen bonds with functional groups of the pigment.

When Ar is bound to the polymer component, it is bound with a single bond or linking group, and the linking group binding to Ar can preferably be a divalent linking group of which a hydrogen atom is removed from the corresponding aryl group and the linking group is selected from the group consisting of an amide group, an ester group, a urethane group, a urea group, an alkylene group, a phenylene group, —O—, —NH— and —NHCH($CH_2OH$)$CH_2$—.

As discussed above, when a single bond or linking group binds to $R_1$, $R_2$ or Ar, it binds by substitution for a hydrogen atom of $R_1$, $R_2$ or Ar, or for a hydrogen atom of a substituent of Ar.

From the standpoint of adsorbability by the pigment, the azo compound represented by Formula (1) above is preferably the azo compound represented by Formula (4) below in the present invention.

[C 3]

Formula (4)

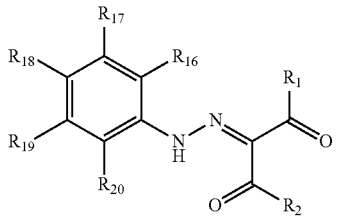

In the present invention, any one of $R_1$, $R_2$ and $R_{16}$ to $R_{20}$ in Formula (4) above is bound to the polymer component binds with a single bond or linking group.

Moreover, $R_1$ and $R_2$ and linking groups binding to $R_1$ and $R_2$ in Formula (4) above are as defined in Formula (1) above.

$R_{16}$ to $R_{20}$ not bound to the polymer portion each independently represent a monovalent group selected from the group consisting of a hydrogen atom, $C_{1-6}$ alkyl group, $C_{1-6}$ alkoxy group, $COOR_{21}$ group and $CONR_{22}R_{33}$ group. $R_{21}$ to $R_{23}$ each independently represent a hydrogen atom, $C_{1-6}$ alkyl group, phenyl group or aralkyl group.

$R_{16}$ to $R_{20}$ in Formula (4) above can be selected from a hydrogen atom, $C_{1-6}$ alkyl group, $C_{1-6}$ alkoxy group, $COOR_{21}$ group or $CONR_{22}R_{33}$ group, but it is desirable that the azo skeleton partial structure be such that at least one of $R_{16}$ to $R_{20}$ is a $COOR_{21}$ group or $CONR_{22}R_{33}$ group in order to improve adsorbability on the pigment by means of hydrogen bonding.

Examples of $C_{1-6}$ alkyl groups in $R_{21}$ to $R_{23}$ in Formula (4) above include methyl, ethyl, n-propyl and isopropyl groups and the like.

$R_{21}$ to $R_{23}$ in Formula (4) above may be selected at will from hydrogen atoms and the substituents listed above, but from the standpoint of adsorbability by the pigment, it is desirable that $R_{21}$ and $R_{22}$ be methyl groups while $R_{23}$ is a methyl group or hydrogen atom. Bulky alkyl groups may inhibit formation of hydrogen bonds with the pigment by steric hindrance, and weaken π-π conjugate interactions. These substituents are preferably selected appropriately so as to form and reinforce hydrogen bonds with functional groups of the pigment.

When $R_{16}$ to $R_{20}$ are bound to the polymer component, on the other hand, they are bound with single bonds or linking groups, and the linking groups binding to $R_{16}$ to $R_{20}$ are preferably divalent linking groups of which a hydrogen atom is removed from the corresponding of any one of $R_{16}$ to $R_{20}$, and linking groups are selected from the group consisting of an amide group, an ester group, a urethane group, a urea group, an alkylene group, a phenylene group, —O—, —NH— and —NHCH($CH_2OH$)$CH_2$—. When the polymer component binds to $R_{16}$ to $R_{20}$ bind via a single bond, moreover, it binds by substitution for a hydrogen atom of $R_{16}$ to $R_{20}$, while when the aforementioned linking group binds to $R_{16}$ to $R_{20}$, it binds by substitution for a hydrogen atom of $R_{16}$ to $R_{20}$.

At least one of $R_1$, $R_2$ and Ar in Formula (1) above is a substituent having a binding segment for binding with the polymer component. From the standpoint of ease of manufacture and adsorbability by the pigment, it is desirable that $R_2$ be a $NR_{10}R_{11}$ group, with $R_{10}$ representing a hydrogen atom and $R_{11}$ a phenyl group having a binding segment for binding with the polymer component.

The combination of substituents in Formula (1) above has been explained using examples, but is not limited to these examples. Adsorbability by the pigment is further improved when Formula (1) above is represented by Formula (5) or (6) below.

[C 4]

Formula (5)

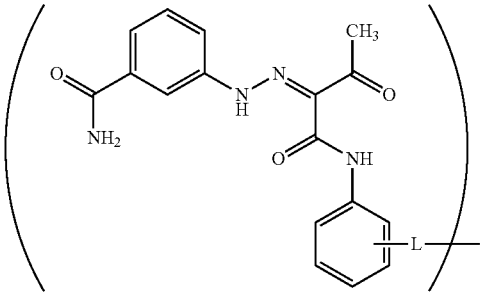

-continued

Formula (6)

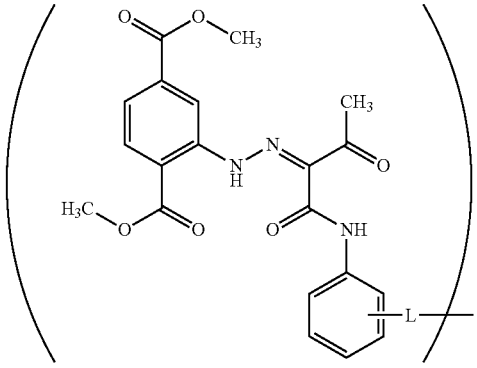

In Formulae (5) and (6) above, L represents a divalent linking group for linking with the polymer component. This linking group is not limited as long as it is a divalent linking group, but from the standpoint of ease of manufacture, desirable examples are divalent linking groups selected from the group consisting of an alkylene group, a phenylene group, and —O—, —NH—, —NHCOC($CH_3$)$_2$— and —NHCH($CH_2OH$)$CH_2$—.

The binding site of L in Formulae (5) and (6) above (site of substitution of phenyl group for hydrogen atom) may be either an ortho, meta or para site relative to the amide group. Adsorbability with the pigment is similar regardless of the substitution site.

As discussed in detail above, in the azo skeleton partial structure the structures of $R_1$ to $R_{23}$ are selected so that the difference in zeta potential between the azo compound of the present invention and the binder resin is within the aforementioned range.

The structures are also preferably selected so that the zeta potential, acid value and adsorbability by the pigment of the azo compound are all within the aforementioned ranges.

Next, the polymer component in Formula (1) is explained in detail.

The structure of the polymer component also needs to be designed so that the difference in zeta potential between the azo compound and the binder resin of the toner is within the aforementioned range. The structure of the polymer component also needs to be designed so that the zeta potential, acid value and adsorbability by the pigment of the azo compound are all within the aforementioned ranges.

From the standpoint of affinity between the azo compound represented by Formula (1) above and the binder resin of the toner, the polymer component of the azo compound preferably has a skeleton having affinity for the binder resin of the toner. When the toner is manufactured by the suspension polymerization method, moreover, the polymer component preferably has a skeleton having affinity for the polymerizable monomer making up the binder resin. That is, when the binder resin of the toner is a vinyl resin, the polymer component of the azo compound is preferably composed principally of a vinyl resin. When the binder resin of the toner is a polyester resin, on the other hand, the polymer component of the azo compound is preferably composed principally of a polyester resin.

When the toner is manufactured by the dissolution suspension method, on the other hand, the polymer component of the azo compound is preferably selected from those with structures having affinity for the organic solvent used in toner manufacture. The binder resin, the polymerizable monomer making up the binder resin and the organic solvent in the case of the dissolution suspension method and the like are together called the dispersion medium in some cases.

As discussed above, when the binder resin of the toner is a vinyl resin, the polymer component of the azo compound in the present invention is preferably one consisting primarily of a vinyl resin. An example of a polymer component consisting primarily of a vinyl resin is a polymer or copolymer containing a monomer unit represented by Formula (2) below as a structural component:

[C 5]

Formula (2)

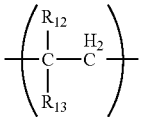

(in Formula (2), $R_{12}$ represents a hydrogen atom or an alkyl group having 1 or 2 carbon atoms, and $R_{13}$ represents a phenyl group, carboxyl group, carboxylic ester group or carboxylic amide group). In the present invention, the polymer component is preferably a copolymer.

The monomer unit represented by Formula (2) above and a polymer component containing at least one kind of the monomer unit represented by Formula (2) above as a structural component are explained here in detail.

From the standpoint of polymerizability of the monomer units, $R_{12}$ in Formula (2) above is preferably a hydrogen atom or a methyl group.

In Formula (2) above, $R_{13}$ is preferably a carboxylic ester group, carboxylic amide group, phenyl group or carboxyl group.

The carboxylic ester group ($COOR_{15}$) is not particularly limited, but examples include those in which $R_{15}$ is an alkyl, such as a methyl, ethyl, n-propyl, n-butyl, n-pentyl, n-hexyl, n-heptyl, n-octyl, n-nonyl, n-decyl, n-undecyl, n-dodecyl, n-tridecyl, n-tetradecyl, n-pentadecyl, n-hexadecyl, n-heptadecyl, n-octadecyl, n-nonadecyl, isopropyl, isobutyl, sec-butyl, tert-butyl, 2-ethylhexyl, cyclopropyl, cyclobutyl, cyclopentyl, cyclohexyl or other linear, branched or cyclic alkyl group.

When $R_{15}$ is an aralkyl, examples include those in which it is a benzyl, α-methylbenzyl or phenethyl group.

From the standpoint of affinity of the toner with the binder resin, $R_{15}$ is preferably a $C_{1-22}$ alkyl group or a $C_{7-8}$ aralkyl group.

Examples of the carboxylic amide in $R_{13}$ in Formula (2) above include N-methylamide, N,N-dimethylamide, N,N-diethylamide, N-isopropylamide, N-tert-butylamide, N-phenylamide and other amide groups.

The substituent of $R_{13}$ in Formula (2) above may itself be further substituted, without any particular limitations as long as substitution does not interfere with the polymerizability of the monomer units or greatly reduce the solubility of the azo compound of the present invention. In this case, possible substituents include methoxy, ethoxy and other alkoxy groups, N-methylamino, N,N-dimethylamino and other amino groups, acetyl and other acyl groups, and fluorine, chlorine and other halogen atoms.

From the standpoint of affinity of the azo compound for the binder resin of the toner, $R_{13}$ in Formula (2) above is preferably a phenyl group or a carboxylic ester group.

Preferred methods of adjusting the acid value of the azo compound in the present invention include adjusting the compositional ratio of the monomer units when $R_{13}$ is a carboxyl group in Formula (2) above, or esterifying the carboxyl groups with a methyl groups or the like.

The affinity of the azo compound of the present invention for the dispersion medium can also be controlled by varying the ratios of the monomer units represented by Formula (2) above in the aforementioned polymer component. For example, when the toner is manufactured by the suspension polymerization method, and the monomer units making up the binder resin are of a non-polar solvent such as styrene, affinity for the dispersion medium can be improved by increasing the ratio of the monomer units represented by Formula (2) above with a phenyl group as $R_{13}$. When the dispersion medium is a somewhat polar solvent such as an acrylic ester, affinity for the dispersion medium can be improved by increasing the ratio of monomer units represented by Formula (2) above in which $R_{13}$ is a carboxyl group, carboxylic ester group or carboxylic amide group.

The mode of polymerization of the polymer component in the present invention may be random copolymerization, alternating copolymerization, periodic copolymerization, block copolymerization or the like. The polymer component may have a linear structure, branched structure or crosslinked structure.

As discussed above, when the binder resin of the toner is a polyester resin, the polymer component of the azo compound is preferably one consisting primarily of a polyester resin.

The case of a polymer component having a polyester skeleton is discussed in detail below. When the binder resin of the toner is a polyester resin, it is desirable from the standpoint of affinity with the binder resin that the polymer component contain a condensed polymer comprising at least monomer units represented by Formula (7) and Formula (8) below as structural components. Alternatively, it is desirable that it contain a condensed polymer comprising monomer units represented by Formula (9) below as structural components:

[C 6]

Formula (7)

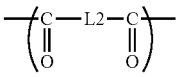

(in Formula (7) $L_2$ represents a divalent linking group)

Formula (8)

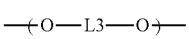

(in Formula (8), $L_3$ represents a divalent linking group)

Formula (9)

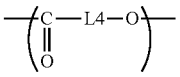

(in Formula (9), $L_4$ represents a divalent linking group).

$L_2$ in Formula (7) above represents a divalent linking group, and preferably $L_2$ is an alkylene group, alkenylene group or arylene group.

Examples of the alkylene group of $L_2$ above include methylene, ethylene, trimethylene, propylene, tetramethylene, hexamethylene, neopentylene, heptamethylene, octamethylene, nonamethylene, decamethylene, undecamethylene, dodecamethylene, 1,3-cyclopentylene, 1,3-cyclohexylene or 1,4-cyclohexylene and other linear, branched or cyclic alkyl groups.

Examples of the alkenylene group of $L_2$ above include vinylene, propenylene or 2-butenylene and the like.

Examples of the arylene group of $L_2$ above include 1,4-phenylene, 1,3-phenylene, 1,2-phenylene, 2,6-naphthylene, 2,7-naphthylene and 4,4'-biphenylene groups and the like.

The substituent of $L_2$ above may itself be further substituted with a substituent to the extent that this does not greatly impair affinity for the dispersion medium. In this case, substituents that can be substituted include a methyl group, halogen atom, carboxyl group and trifluoromethyl group and combinations of these.

$L_2$ above can be selected at will from the substituents listed above, but from the standpoint of affinity for the dispersion medium and for non-polar solvents in particular, a phenylene group or alkylene group having 6 or more carbon atoms is preferred, and a combination of these is also possible.

$L_3$ in Formula (8) above represents a divalent linking group, and from the standpoint of affinity for the dispersion medium, $L_3$ may be an alkylene or phenylene group, or Formula (8) may be represented by Formula (10) below:

[C 7]

Formula (10)

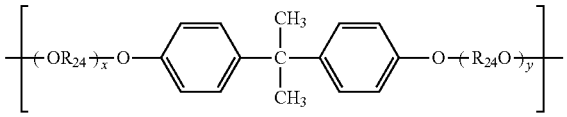

(in Formula (10), $R_{24}$ represents an ethylene or propylene group, x and y are each an integer of 0 or greater, and the average value of x+y is 2 to 10).

The alkylene groups given as examples in Formula (7) above are also examples of the alkylene group of $L_3$ in Formula (8) above.

Examples of the phenylene group of $L_3$ above include 1,4-phenylene, 1,3-phenylene, 1,2-phenylene.

The substituent of $L_3$ above may also itself be further substituted with a substituent as long as this does not greatly impair affinity with the dispersion medium. In this case, substituents that can be substituted include methyl, alkoxy and hydroxyl groups, halogen atoms, and combinations of these.

$L_3$ above can be selected at will from the substituents listed above, but from the standpoint of affinity for the dispersion medium and for non-polar solvents in particular, a phenylene group or alkylene group having 6 or more carbon atoms or one that gives the bisphenol A derivative represented by Formula (10) for Formula (8) above is preferred, and a combination of these is also possible.

$L_4$ in Formula (9) above represents a divalent linking group, and $L_4$ is preferably an alkylene group or alkenylene group.

Examples of the alkylene group of $L_4$ above include the alkylene groups given as examples in Formula (7) above.

Examples of the alkenylene group of $L_4$ above include vinylene, propenylene, butenylene, butadienylene, pentenylene, hexenylene, hexadienylene, heptenylene, octanylene, decenylene, octadecenylene, eicosenylene and triacontenylene groups and the like. These alkenylene groups may have linear, branched or cyclic structures. The double bond may be at any location as long as there is at least one double bond.

The substituent of $L_4$ above may itself be substituted with a substituent as long as this does not greatly impair affinity for the dispersion medium. In this case, substituents that can be substituted include alkyl, alkoxy and hydroxyl groups, halogen atoms and combinations of these.

$L_4$ above can be selected at will from the substituents listed above, but from the standpoint of affinity for the dispersion medium and for non-polar solvents in particular, an alkylene or alkenylene having 6 or more carbon atoms is preferred, and a combination of these is also possible.

Regarding the molecular weight of the polymer component, the number-average molecular weight (Mn) as measured using a size-exclusion chromatograph (SEC) is preferably 500 or more for purposes of improving the dispersibility of the pigment in the binder resin. A higher molecular weight has the effect of improving the dispersibility of the pigment, but if the molecular weight is too great it may depress affinity between the polymerizable monomer and the pigment in the case of suspension polymerization and affinity between the organic solvent and the pigment in the case of dissolution suspension polymerization. Thus, the number-average molecular weight of the polymer component is preferably no more than 200,000. When ease of manufacture is also taken into consideration, the number-average molecular weight of the polymer component is preferably in the range of 3000 to 30,000.

With polyoxyalkylene carbonyl dispersants, a method is known of improving dispersibility by adding a branched aliphatic chain to the terminus, and in the case of the polymer component of the present invention, dispersibility can also be improved by adding a branched aliphatic chain to the terminus if a telechelic polymer component is synthesized by a method such as the atom transfer radial polymerization (ATRP) method discussed below.

Regarding the position of the azo skeleton partial structure in the azo compound of the present invention, it may be scattered randomly in the polymer component or distributed unevenly so as to form one or more blocks at one end. The larger the number of azo skeleton partial structures in the azo compound, the greater the adsorbability by the pigment, but if there are too many they will tend to reduce affinity for the polymerizable monomer in the suspension polymerization method and for the organic solvent used in the dissolution suspension method. Thus, the number of azo skeleton partial structures is preferably in the range of 0.5 to 15.0 or more preferably 2.0 to 10.0 per 100 monomer units forming the polymer component.

The azo skeleton partial structure represented by Formula (1) above has the tautomers represented by Formulae (11) and (12) as shown below. These tautomers are also within the scope of rights of the present invention. Because the azo skeleton partial structure of the present invention has tautomers, even stronger π-π conjugate interactions with the pigment can be obtained than with conventional pigment dispersants due to resonance structures formed not only by aryl groups in the azo skeleton partial structure represented by Formula (1) above, but also by azo bonds bound directly to the aryl groups and carbonyl groups disposed so as to resonate by affecting the azo bonds.

[C 8]

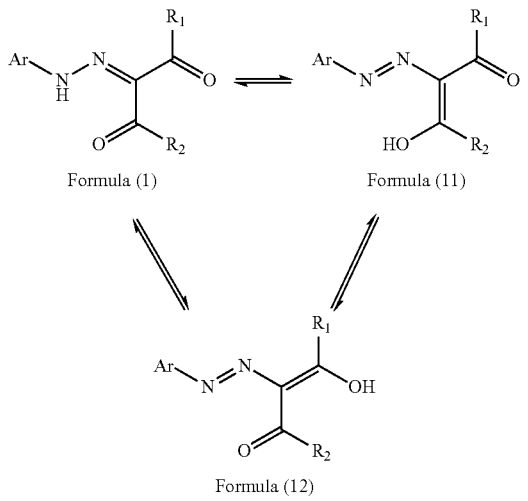

(in Formulae (11) and (12), $R_1$, $R_2$ and Ar are as defined in the same way as $R_1$, $R_2$ and Ar in Formula (1)).

The azo compound of the present invention can be synthesized by known methods.

Methods of synthesizing the azo compound of the present invention include the methods shown in (i) to (iv) below.

First, method (i) is explained in detail based on an example of the scheme shown below:

Method (i)

[C 9]

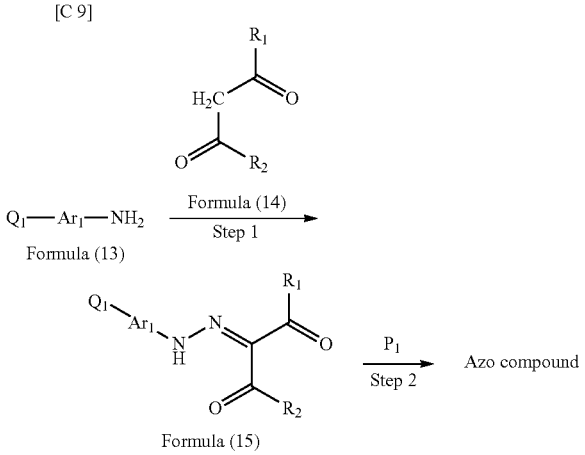

(in Formulae (14) and (15), $R_1$ and $R_2$ are defined in the same way as $R_1$ and $R_2$ in Formula (1) above. $Ar_1$ in Formulae (13) and (15) represents an arylene group. $P_1$ is the polymer component, and is for example a polymer or copolymer containing a monomer unit represented by Formula (2) above as a structural component. $Q_1$ in Formulae (13) and (15) represents a substituent that reacts with $P_1$ to form a single bond or divalent linking group).

In the scheme of method (i) given as an example above, the azo compound can be synthesized by a step 1 of diazo coupling the aniline derivative represented by Formula (13) with compound (14) to synthesize azo skeleton partial structure (15), and a step 2 of binding the azo skeleton partial structure (15) with the polymer component $P_1$ by means of a condensation reaction or the like.

Step 1 is explained first. A known method is used in step 1. Specifically, the following method may be used for example. First, the aniline derivative (13) is reacted in a methanol solvent with a diazotizing agent such as sodium nitrite or nitrosylsulfuric acid in the presence of hydrochloric acid or an inorganic acid such as sulfuric acid, to synthesize the corresponding diazonium salt. This diazonium salt is then coupled with compound (14) to synthesize the azo skeleton partial structure (15).

The aniline derivative (13) can be easily obtained in various commercial forms. It can also be easily synthesized by known methods.

This step can be performed without a solvent, but is preferably performed in the presence of a solvent to prevent the reaction from progressing too rapidly. The solvent is not particularly limited as long as it does not impede the reaction, but examples include methanol, ethanol, propanol and other alcohols, methyl acetate, ethyl acetate, propyl acetate and other esters, diethyl ether, tetrahydrofuran, dioxane and other ethers, benzene, toluene, xylene, hexane, heptane and other hydrocarbons, dichloromethane, dichloroethane, chloroform and other halocarbons, N,N-dimethylformamide, N-methylpyrrolidone, N,N-dimethylimidzolidinone and other amides, acetonitrile, propionitrile and other nitriles, formic acid, acetic acid, propionic acid and other acids, and water and the like. A mixture of two or more of these solvents may also be used, and the mixing ratios may be determined at will during mixing and use according to the solubility of the substrate. The amount of the solvent used can be determined at will, but from the standpoint of the reaction speed, is preferably in the range of 1.0 to 20 mass parts of the compound represented by Formula (13) above.

This step is normally performed at a temperature range of −50° C. to 100° C., and is normally completed within 24 hours.

The method of synthesizing the polymer component $P_1$ used in step 2 is explained next. A known polymerization method can be used for synthesizing the polymer component $P_1$.

Specific examples include radical polymerization, cationic polymerization and anionic polymerization, but radical polymerization is preferred from the standpoint of ease of manufacture.

Radical polymerization can be accomplished using a radical polymerization initiator, by exposure to radiation, laser light or the like, by light exposure in combination with a photopolymerization initiator, or by heating or the like.

The radical polymerization initiator can be any that produces radicals and initiates a polymerization reaction, and is selected from compounds that produce radicals in response to heat, light, radiation, oxidation-reduction reactions or the like. Examples include azo compounds, organic peroxides, inorganic peroxides, organic metal compounds, photopolymerization initiators and the like. More specific examples include 2,2'-azobis(isobutyronitrile), 2,2'-azobis(2-methylbutyronitrile), 2,2'-azobis(4-methoxy-2,4-dimethylvaleronitrile), 2,2'-azobis(2,4-dimethylvaleronitrile) and other azo polymerization initiators, benzoyl peroxide, di-tert-butylperoxide, tert-butylperoxisopropyl carbonate, tert-hexylperoxibenzoate, tert-butylperoxybenzoate and other organic peroxide polymerization initiators, potassium persulfate, ammonium persulfate and other inorganic peroxide polymerization initiators, and hydrogen peroxide-ferrous iron, benzoyl peroxide-dimethylaniline, cerium (IV) salt-alcohol and other redox initiators and the like. Examples of photopolymerization initiators include benzophenones, bezoin ethers, acetophenones, thioxanthones and the like. A combination of two or more of these radical polymerization initiators may also be used.

The amount of the polymerization initiator used here is preferably adjusted within the range of 0.1 to 20 mass parts per 100 mass parts of the monomer so as to obtain a polymer component with the desired molecular weight distribution.

The polymer component represented by $P_1$ above can be manufactured using any of a number of methods including solution polymerization, suspension polymerization, emulsion polymerization, dispersion polymerization, precipitation polymerization and bulk polymerization, without any particular limitations, but solution polymerization in a solvent capable of dissolving the various components used in manufacture is preferred.

The molecular weight distribution and molecular structure of the polymer component represented by $P_1$ above can be controlled by known methods. For example, methods using addition-fragmentation chain transfer agents, NMP methods using dissociation and binding of amine oxide radicals, ATRP polymerization methods using heavy metals and ligands with a halogen compound as the polymerization initiator, RAFT methods using a dithiocarboxylic ester or xanthate compound or the like as the polymerization initiator, or MADIX methods, DT methods or the like can be used to control the molecular weight distribution and molecular structure when manufacturing the polymer component.

Step 2 is explained next. Known methods can be used for step 2. Specifically, for example, the aforementioned segment azo compound comprising $P_1$ and $Q_1$ connected by a carboxylic ester bond can be synthesized using a polymer component $P_1$ having a carboxyl group and an azo skeleton partial structure (15) in which $Q_1$ is a substituent having a hydroxyl group. The aforementioned azo compound comprising $P_1$ and $Q_1$ connected by a sulfonic ester bond can also be synthesized by using a polymer component $P_1$ having a hydroxyl group and an azo skeleton partial structure (15) in which $Q_1$ is a substituent having a sulfonic acid group. Moreover, the aforementioned azo compound comprising $P_1$ and $Q_1$ connected by a carboxylic amide bond can be synthesized using a polymer component $P_1$ having a carboxyl group and an azo skeleton partial structure (15) in which $Q_1$ is a substituent having an amino group. Specific methods include methods using dehydration-condensation agents, such as methods using 1-ethyl-3-(3-dimethylaminopropyl)carbodiimide hydrochloride and the like, and the Schotten-Baumann method and the like.

This step may be performed without a solvent, but is preferably performed in the presence of a solvent to prevent the reaction from progressing too rapidly. The solvent is not particularly limited as long as it does not impede the reaction, but examples include diethyl ether, tetrahydrofuran, dioxane and other ethers, benzene, toluene, xylene, hexane, heptane and other hydrocarbons, dichloromethane, dichloroethane, chloroform and other halocarbons, N,N-dimethylformamide, N-methylpyrrolidone, N,N-dimethylimidazolidinone and other amides, and acetonitrile, propionitrile and other nitriles and the like. A mixture of two or more of these solvents may also be used, and the mixing ratios may be determined at will during mixing and use according to the solubility of the substrate. The amount of the solvent used can be determined at will, but from the standpoint of the reaction speed, it is preferably in the range of 1.0 to 20 mass parts of the compound represented by Formula (15) above. This step is normally performed at a temperature range of 0° C. to 250° C., and is normally completed within 24 hours.

Next, method (ii) is explained in detail based on an example of the scheme shown below:

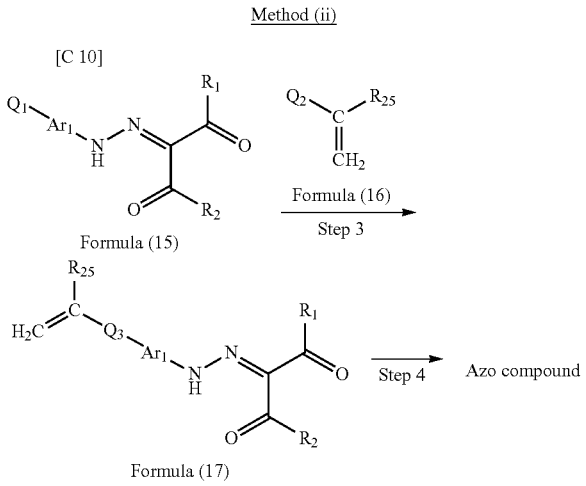

(in Formula (15), $R_1$, $R_2$, $Ar_1$ and $Q_1$ are each defined in the same way as $R_1$, $R_2$, $Ar_1$ and $Q_1$ in Formula (15) of the scheme of method (i). $Q_2$ in Formula (16) represents a substituent that reacts with $Q_1$ in Formula (15) to form $Q_3$ in Formula (17). $R_{25}$ in Formulae (16) and (17) represents a hydrogen atom or alkyl group, and $Q_3$ represents a substituent constituting a divalent linking group formed when $Q_1$ in Formula (15) reacts with $Q_2$ in Formula (16).

In the scheme of the method (ii) given as an example above, the azo compound can be synthesized by a step 3 of reacting the azo skeleton partial structure represented by Formula (15) with the vinyl group-containing compound represented by Formula (16) to synthesize an azo skeleton partial structure (17) having a polymerizable functional group, and a step 4 of copolymerizing the azo skeleton partial structure (17) having a polymerizable functional group with the monomer unit represented by Formula (2) above.

Step 3 is explained first. In step 3, an azo skeleton partial structure (17) having a polymerizable functional group can be synthesized using a method similar to the step 2 of method (i). Specifically, using a vinyl group-containing compound (16) having a carboxyl group and an azo skeleton partial structure (15) in which $Q_1$ is a substituent having a hydroxyl group for example, it is possible to synthesize an azo skeleton partial structure (17) that is linked with carboxylic ester bonds and has the aforementioned polymerizable functional groups. Using a vinyl group-containing compound (16) having a hydroxyl group and an azo skeleton partial structure (15) in which $Q_1$ is a substituent having a sulfonic acid group, it is possible to synthesize an azo skeleton partial structure (17) that is linked with sulfonic ester bonds and has the aforementioned polymerizable functional groups. Furthermore, using a vinyl group-containing compound (16) having a carboxyl group and an azo skeleton partial structure (15) in which $Q_1$ is a substituent having an amino group, it is possible to synthesize an azo compound that is linked with carboxylic amide bonds and has the aforementioned polymerizable functional groups. The vinyl group-containing compound (16) is easily available in various commercial forms, and can also be easily synthesized by known methods.

Step 4 is explained next. In step 4, the azo compound represented by Formula (1) above can be synthesized using methods similar to those used to synthesize the polymer component $P_1$ in method (i) above.

Next, method (iii) is explained in detail based on an example of the scheme shown below:

Method (iii)

[C 11]

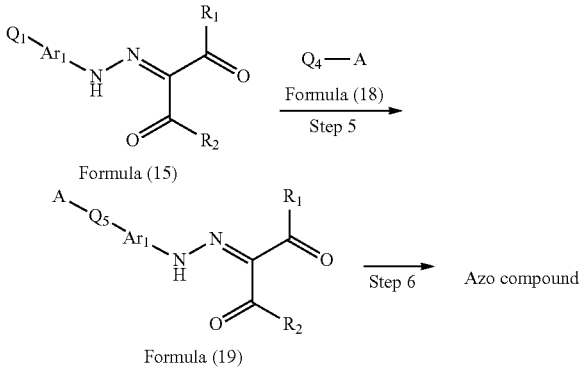

(in Formula (15), $R_1$, $R_2$, $Ar_1$ and $Q_1$ are each defined in the same way as $R_1$, $R_2$, $Ar_1$ and $Q_1$ in Formula (15) of the scheme of method (i). $Q_4$ in Formula (18) represents a substituent that reacts with $Q_1$ in Formula (15) to form $Q_5$ in Formula (19). A represents a chlorine atom, bromine atom or iodine atom. $R_1$, $R_2$ and $Ar_t$ in Formula (19) are defined in the same way as $R_1$, $R_2$ and $Ar_t$ in formula (15), and $Q_5$ represents a linking group formed when $Q_1$ in Formula (15) reacts with $Q_4$ in Formula (18).

In the scheme of method (iii) given as an example above, the azo compound can be synthesized by means of a step 5 of reacting the azo skeleton partial structure represented by Formula (15) with the halogen atom-containing compound represented by Formula (18) to synthesize an azo skeleton partial structure (19) having a halogen atom, and a step 6 of using the azo skeleton partial structure (19) having a halogen atom as a polymerization initiator to polymerize the monomer units represented by Formula (2) above.

Step 5 is explained first. In step 5, an azo skeleton partial structure (19) having a halogen atom can be synthesized using a method similar to the step 2 of method (i) above. Specifically, using a halogen atom-containing compound (18) having a carboxyl group and an azo skeleton partial structure (15) in which $Q_1$ is a substituent having a hydroxyl group for example, it is possible to synthesize an azo skeleton partial structure (19) having a halogen atom. It is also possible to synthesize an azo skeleton partial structure (19) having a halogen atom using a halogen atom-containing compound (18) having a hydroxyl group and an azo skeleton partial structure (15) in which $Q_1$ is a substituent having a sulfonic acid group. Moreover, it is also possible to synthesize an azo skeleton partial structure (19) having a halogen atom by using a halogen atom-containing compound (18) having a carboxyl group and an azo skeleton partial structure (15) in which $Q_1$ is a substituent having an amino group.

Examples of the halogen atom-containing compound (18) having a carboxyl group include chloroacetic acid, α-chloropropionic acid, α-chlorobutyric acid, α-chloroisobutyric acid, α-chlorovaleric acid, α-chloroisovaleric acid, α-chlorocaproic acid, α-chlorophenylacetic acid, α-chlorodiphenylacetic acid, α-chloro-α-phenylpropionic acid, α-chloro-β-phenylpropionic acid, bromoacetic acid, α-bromopropionic acid, α-bromobutyric acid, α-bromoisobutyric acid, α-bromovaleric acid, α-bromoisovaleric acid, α-bromocaproic acid, α-bromophenylacetic acid, α-bromodiphenylacetic acid, α-bromo-α-phenylpropionic acid, α-bromo-β-phenylpropionic acid, iodoacetic acid, α-iodopropionic acid, α-iodobutyric acid, α-iodoisobutyric acid, α-iodovaleric acid, α-iodoisovaleric acid, α-iodocaproic acid, α-iodophenylacetic acid, α-iododiphenylacetic acid, α-iodo-α-phenylpropionic acid, α-iodo-β-phenylpropionic acid, β-chlorobutyric acid, β-bromoisobutyric acid, iododimethylmethylbenzoic acid, 1-chloroethylbenzoic acid and the like. Acid halides and acid anhydrides of these can similarly be used in the present invention.

Examples of the halogen atom-containing compound (18) having a hydroxyl group include 1-chloroethanol, 1-bromoethanol, 1-iodoethanol, 1-chloropropanol, 2-bromopropanol, 2-chloro-2-propanol, 2-bromo-2-methylpropanol, 2-phenyl-1-bromoethanol, 2-phenyl-2-iodoethanol and the like.

Step 6 is explained next. In step 6 the azo compound can be synthesizing using known ATRP methods in the method (i) above, by polymerizing the monomer units represented by Formula (2) above using the azo skeleton partial structure (19) having halogen atoms as a polymerization initiator in the presence of a metal catalyst and a ligand.

When $R_2$ in Formula (1) above is a $NR_{10}R_{11}$ group, $R_{10}$ is a hydrogen atom and $R_{11}$ is a phenyl group, the azo compound can also be synthesized by the following method (iv) for example:

Method (iv)

[C 12]

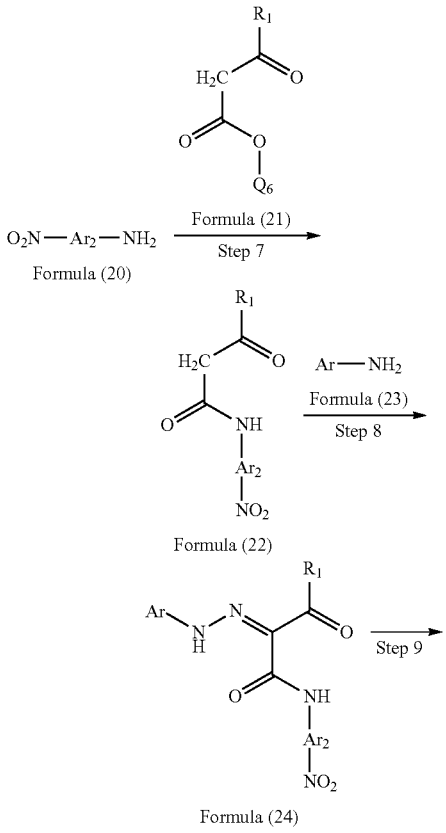

-continued

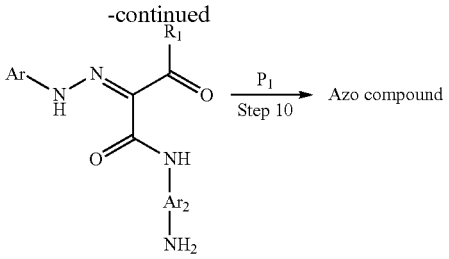

Formula (25)

(in Formulae (20), (22), (24) and (25), $Ar_2$ represents an arylene group. In Formulae (21), (22), (24) and (25), $R_1$ is as defined in Formula (1) above. $Q_6$ in Formula (21) represents a substituent that dissociates when the amide group of Formula (22) is formed by a reaction with the amino group of Formula (20). $P_1$ is defined in the same way as $P_1$ in the scheme of method (i)).

In the scheme of method (iv) given as an example above, the azo compound can be synthesized by means of a step 7 in which the aniline derivative represented by Formula (20) and compound (21) are amidated to obtain a compound (22), a step 8 in which compound (22) and the diazo component of the aniline analog represented by Formula (23) are coupled to obtain the azo skeleton partial structure represented by Formula (24), a step 9 in which the nitro groups of the azo skeleton partial structure represented by Formula (24) are reduced to amino groups with a reducing agent to obtain the azo skeleton partial structure represented by Formula (25), and a step 10 in which the amino groups of the azo skeleton partial structure represented by Formula (25) and the carboxyl groups of the separately synthesized polymer component represented by $P_1$ are bound by amidation.

Step 7 is explained first. Known methods can be used in step 7. When $R_1$ in the compound (21) is a methyl group, synthesis can also be accomplished by a method using diketene instead of the compound (21). The aforementioned compound (21) is easily available in various commercial forms. It can also be easily synthesized by known methods.

This step can be performed without a solvent, but is preferably performed in the presence of a solvent to prevent the reaction from progressing too rapidly. The solvent is not particularly limited as long as it does not impede the reaction, but toluene, xylene or another solvent with a high boiling point can be used for example.

Step 8 is explained next. In step 8, the azo skeleton partial structure (24) can be synthesized by a method similar to step 1 in method (i) above.

Step 9 is explained next. In step 9, a nitro group reduction reaction can be performed by methods such as those shown below. First, the azo skeleton partial structure (24) is dissolved in an alcohol or the like, and the nitro groups of the azo skeleton partial structure (24) are reduced to amino groups in the presence of a reducing agent at room temperature or with heating to obtain the azo skeleton partial structure (25). The reducing agent is not particularly limited, but examples include sodium sulfide, sodium hydrogen sulfide, sodium hydrosulfide, sodium polysulfide, iron, zinc, tin, $SnCl_2$, $SnCl_2.2H_2O$ and the like. This reducing reaction can also be accomplished by a method involving contact with hydrogen gas in the presence of a catalyst comprising a metal such as nickel, platinum or palladium supported on an active carbon or other insoluble carrier.

Step 10 is explained next. In step 10, the azo compound can be synthesized using methods similar to step 2 in method (i) above, by binding the amino groups of the azo skeleton partial structure of Formula (25) with the carboxyl groups of the polymer component represented by $P_1$ by amidation.

The compounds obtained by each step in the synthesis methods given as examples above can be purified by common methods of isolating and purifying organic compounds, such as recrystallization or re-precipitation using an organic solvent, or column chromatography using silica gel or the like. A highly pure compound can be obtained by purification using one of these methods alone or a combination of two or more.

The toner and toner manufacturing method of the present invention are explained next in detail.

The weight-average particle diameter (D4) of the toner of the present invention is preferably 4.0 μm to 9.0 μm, or more preferably 5.0 μm to 7.5 μm.

If the weight-average particle diameter of the toner is less than 4.0 μm, there is a greater likelihood of charge-up, which is then likely to cause fogging, scattering, negative ghosting and other adverse effects. The charge-providing member is also more likely to be contaminated during long-term image output, making it more difficult to provide stable high image quality. Not only is it difficult to clean the residual untransferred toner on the photosensitive member, moreover, but fusion and the like are also more likely.

Conversely, if the weight-average particle diameter of the toner exceeds 9.0 μm, it is likely to cause a reduction in fine line reproducibility of small characters and the like, as well as a reduction in image scattering.

The method of manufacturing the toner of the present invention is a method of producing a toner in an aqueous medium as discussed above, and specifically is the suspension polymerization method or dissolution suspension method.

In the toner manufacturing method of the present invention, the dispersibility of the pigment can be improved by mixing a dispersion medium, a pigment and the azo compound in advance to prepare a pigment composition (master batch). Specifically, a pigment composition (master batch) is prepared as follows for example. The azo compound and pigment powder are added to the dispersion medium together with other raw materials for the toner as necessary, and blended thoroughly with the dispersion medium with agitation. Further, the pigment in the form of uniform fine particles is finely and stably dispersed with a disperser such as a kneader, roll mill, ball mill, paint shaker, dissolver, attritor, sand mill, high-speed mill, SC mill, star mill, ultrasonic disperser or the like.

There are no particular limitations on the dispersion mediam that can be used in the present invention, but to achieve the superior pigment dispersion effect of the azo compound of the present invention, a polymerizable monomer for making up the binder resin of the toner is preferred in the case of the suspension polymerization method, while in the case of the dissolution suspension method, an organic solvent used for dissolving the binder resin is preferred.

Toner particles manufactured by the suspension polymerization method are manufactured as follows for example. The pigment composition and a polymerizable monomer are mixed together with a release agent and polymerization initiator as necessary, to prepare a polymerizable monomer composition. Next, this polymerizable monomer composition is dispersed in an aqueous solvent, and particles of the polymerizable monomer composition are granulated. The polymerizable monomer in the particles of the polymerizable monomer composition is then polymerized in the aqueous solvent to obtain toner particles.

Desirable examples of the polymerizable monomer include vinyl polymerizable monomers that can be radical polymerized. A monofunctional polymerizable monomer or polyfunctional polymerizable monomer can be used as the vinyl polymerizable monomer. The following are examples of monofunctional polymerizable monomers: styrene; α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene and other styrene derivatives; methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethylphosphate ethyl acrylate, diethyl phosphate ethyl acrylate, dibutyl phosphate ethyl acrylate, 2-benzoyloxy ethyl acrylate and other acrylic polymerizable monomers; methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethylphosphate ethyl methacrylate, dibutylphosphate ethyl methacrylate and other methacrylic polymerizable monomers; methylene aliphatic monocarboxylic esters; vinyl acetate, vinyl propionate, vinyl butyrate, vinyl benzoate, vinyl formate and other vinyl esters; vinyl methyl ether, vinyl ethyl ether, vinyl isobutyl ether and other vinyl ethers; and vinyl methyl ketone, vinyl hexyl ketone, vinyl isopropyl ketone and other vinyl ketones.

The following are examples of polyfunctional polymerizable monomers: diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis(4-(acryloxy diethoxy)phenyl)propane, trimethylol propane triacrylate, tetramethylol methane tetracrylate, ethylene glycol dimethacrylate, diethylene glycol dimethacrylate, triethylene glycol dimethacrylate, tetraethylene glycol dimethacrylate, polyethylene glycol diemthacryalte, 1,3-butylene glycol dimethacrylate, 1,6-hexanediol dimethacrylate, neopentyl glycol dimethacrylate, polypropylene glycol dimethacrylate, 2,2'-bis(4-(methacryloxy diethoxy)phenyl)propane, 2,2'-bis(4-(methacryloxy polyethoxy)phenyl)propane, trimethylol propane trimethacrylate, tetramethylol methane tetramethacrylate, divinyl benzene, divinyl naphthaline and divinyl ether.

A single monofunctional polymerizable monomer or a combination of two or more may be used, or a monofunctional polymerizable monomer may be combined with a polyfunctional polymerizable monomer. The polyfunctional polymerizable monomer may also be used as a crosslinking agent.

The polymerization monomer composition of this step is preferably prepared by dispersing the pigment and azo compound in a first polymerizable monomer to obtain a liquid dispersion that is then mixed and dispersed with a second polymerizable monomer. That is, the pigment is present in the toner particles in a more dispersed state if the pigment and azo compound are first dispersed thoroughly in a first polymerizable monomer before being mixed and dispersed together with the other toner materials in a second polymerizable monomer.

An oil-soluble initiator and/or water-soluble initiator is used as the polymerization initiator for polymerizing the polymerizable monomers. The following are examples of oil-soluble initiators: 2,2'-azobisisobutyronitrile, 2,2'-azobis-2,4-dimethylvaleronitrile, 1,1'-azobis(cyclohexane-1-carbonitrile), 2,2'-azobis-4-methoxy-2,3-dimethylvalernotrile and other azo compounds; and acetylcyclohexyl sulfonyl peroxide, diisopropyl peroxycarbonate, decanonyl peroxide, lauroyl peroxide, stearoyl peroxide, propionyl peroxide, acetyl peroxide, t-butylperoxy-2-ethylhexanoate, benzoyl peroxide, t-butylperoxy isobutyrate, cyclohexanone peroxide, methylethyl ketone peroxide, dicumyl peroxide, t-butyl hydroperoxide, di-t-butyl peroxide, cumen hydroperoxide and other peroxide initiators.

The following are examples of water-soluble initiators: ammonium persulfate, potassium persulfate, 2,2'-azobis(N,N'-dimethylene isobutyroamidine) hydrochloride, 2,2'-azobis(2-aminodinopropane) hydrochloride, azobis(isobutylamidine) hydrochloride, 2,2'-azobisisobutyronitrile sodium sulfonate, ferrous sulfate or hydrogen peroxide.

A chain transfer agent, polymerization inhibitor or the like may also be added in order to control the degree of polymerization of the polymerizable monomer.

The concentration of the polymerization initiator is in the range of preferably 0.1 to 20 mass parts or more preferably 0.1 to 10 mass parts per 100 mass parts of the polymerizable monomer.

The type of polymerization initiator differs somewhat depending on the polymerization method, and they may be used alone or mixed with reference to the 10-hour half-life temperature.

A crosslinking agent can also be used when synthesizing the binder resin in the present invention in order to control the molecular weight of the toner while improving its stress resistance.

A compound having two or more polymerizable double bonds can be used as the crosslinking agent. Specific examples include divinyl benzene, divinyl naphthalene and other aromatic divinyl compounds; ethylene glycol diacrylate, ethylene glycol dimethacrylate, 1,3-butanediol dimethacrylate and other carboxylic esters having two double bonds; divinyl aniline, divinyl ether, divinyl sulfide, divinyl sulfone and other divinyl compounds; and compounds having three or more vinyl groups. These can be used alone or in combination. From the standpoint of toner fixing performance and offset resistance, these crosslinking agents are used in the amount of preferably 0.05 to 10 mass parts or more preferably 0.1 to 5 mass parts per 100 mass parts of the polymerizable monomer.

The polymerizable monomer and crosslinking agent are used independently, or else the polymerizable monomer is mixed appropriately so as to obtain a theoretical glass transition temperature (Tg) in the range of 40 to 75° C. If the theoretic glass transition temperature is less than 40° C., there are likely to be problems of toner storage stability and stress resistance, while if it exceeds 75° C., transparency and low-temperature fixing performance may be diminished when forming full color images with the toner.

The aqueous solvent used in the suspension polymerization method preferably contains a dispersion stabilizer. A known inorganic or organic dispersion stabilizer can be used as the dispersion stabilizer. Examples of inorganic dispersion stabilizers include calcium phosphate, magnesium phosphate, aluminum phosphate, zinc phosphate, magnesium carbonate, calcium carbonate, calcium hydroxide, magnesium hydroxide, aluminum hydroxide, calcium metasilicate, calcium sulfate, barium sulfate, bentonite, silica and alumina. Examples of organic dispersion stabilizers include polyvinyl alcohol, gelatin, methyl cellulose, methyl hydroxypropyl cellulose, ethyl cellulose, carboxymethyl cellulose sodium salt, starch and the like. A nonionic, anionic or cationic surfactant can also be used. Examples include dodecyl sodium sulfate, tetradecyl sodium sulfate, pentadecyl sodium sulfate, octyl sodium sulfate, sodium oleate, sodium laurate, potassium stearate, potassium oleate and the like.

Of these dispersion stabilizers, an inorganic dispersion stabilizer with poor water solubility that is soluble in acid is preferably used in the present invention. When using an inorganic dispersion stabilizer with poor water solubility to prepare an aqueous medium in the present invention, it is desirable from the standpoint of the drop stability of the polymerizable monomer composition in the aqueous medium that these dispersion stabilizers be used in the amount of 0.2 to 2.0 mass parts per 100 mass parts of the polymerizable monomer. Also, in the present invention the aqueous medium is preferably prepared using water in the amount of 300 to 3000 mass parts per 100 mass parts of the polymerizable monomer composition.

When preparing an aqueous medium having an inorganic dispersion stabilizer with poor water solubility dispersed therein in the present invention, a commercial dispersion stabilizer can be dispersed as is, but for purposes of obtaining dispersion stabilizer particles with a fine uniform particle size, it is desirable to produce the inorganic dispersion stabilizer with poor water solubility in water under high-speed agitation. For example, when using calcium phosphate as the dispersion stabilizer, a desirable dispersion stabilizer can be obtained by mixing a sodium phosphate aqueous solution with a calcium chloride aqueous solution under high-speed agitation to thereby form fine particles of calcium phosphate.

Because no heating step is included in the process of manufacturing the toner of the present invention by the dissolution suspension method, it is possible to suppress the compatibilization of the binder resin and release agent that occurs when using a low-melting-point release agent, and thereby prevent a drop in the glass transition temperature of the toner due to compatibilization. Moreover, there is wide choice of toner materials for the binder resin in the dissolution suspension method, and it is easy to use a polyester resin as the principal component, which is considered advantages for fixing performance.

Toner particles manufactured by this dissolution suspension method can be manufactured as follows for example. First, the pigment composition and binder resin, together with a release agent and the like as necessary, are dissolved or dispersed in an organic solvent to obtain a mixed solution. This mixed solution is then dispersed in an aqueous solvent, and particles of the mixed solution are granulated. The organic solvent contained in the granulated particles is then removed by heating or reduced pressure to obtain toner particles.

The mixed solution in this step is preferably prepared by mixing the second organic solvent with a liquid dispersion obtained by dispersing the pigment and azo compound in the first organic solvent. That is, the pigment particles can be included in a more dispersed state in the toner particles by first dispersing the pigment and azo compound thoroughly in the first organic solvent, and then mixing this with the second organic solvent together with the other toner materials. Examples of organic solvents that can be used in this dissolution suspension method include toluene, xylene, hexane and other hydrocarbons, methylene chloride, chloroform, dichloroethane, trichloroethane, carbon tetrachloride and other halocarbons, methanol, ethanol, butanol, isopropyl alcohol and other alcohols, ethylene glycol, propylene glycol, diethylene glycol, triethylene glycol and other polyols, methyl cellosolve, ethyl cellosolve and other cellosolves, acetone, methyl ethyl ketone, methyl isobutyl ketone and other ketones, benzyl alcohol ethyl ether, benzyl alcohol isopropyl ether, tetrahydrofuran and other ethers, and methyl acetate, ethyl acetate, butyl acetate and other esters. One of these or a mixture of two or more may be used. Of these, it is desirable to use an organic solvent that has strong affinity with the azo compound of the present invention, is capable of thoroughly dissolving the binder resin, and has a low boiling point to facilitate removal of the organic solvent contained in the granulated particles.

The organic solvent is used in the amount of preferably 50 to 5000 mass parts or more preferably 120 to 1000 mass parts per 100 mass parts of the binder resin.

The aqueous medium used in the aforementioned dissolution suspension method is preferably made to contain a dispersion stabilizer. Known inorganic and organic dispersion stabilizers may be used as the dispersion stabilizer. Examples of inorganic dispersion stabilizers include calcium phosphate, calcium carbonate, aluminum hydroxide, calcium sulfate, barium carbonate and the like. Examples of organic dispersion stabilizers include polyvinyl alcohol, methyl cellulose, hydroxyethyl cellulose, ethyl cellulose, carboxymethyl cellulose sodium salt, sodium polyacrylate, sodium polymethacrylate and other water-soluble polymers, sodium dodecylbenzenesulfonate, sodium octadecylsulfate, sodium oleate, sodium laurate, potassium stearate and other anionic surfactants, lauryl amine acetate, stearyl amine acetate, lauryl trimethyl ammonium chloride and other cationic surfactants, lauryl dimethylamine oxide and other zwitterionic surfactants, polyoxyethylene alkyl ether, polyoxyethylene alkyl phenyl ether, polyoxyethylene alkylamine and other nonionic surfactants, and other surfactants and the like.

Using the dispersion stabilizer in the amount of 0.01 to 20 mass parts per 100 mass parts of the binder resin is desirable from the standpoint of the drop stability of the mixed solution in the aqueous medium.

By adding a polar resin to the polymerizable monomer composition in the suspension polymerization method and to the mixed solution in the dissolution suspension method when manufacturing the toner, it is possible to obtain toner particles having a core-shell structure comprising the binder resin and release agent (core) coated with a polar resin (shell). Thus, with a toner obtained by this manufacturing method, toner deterioration during continuous printing can be controlled for example by enveloping the release agent in the toner, so that even if a relatively large amount of release agent is included, it is not exposed on the toner surface.

Examples of the polar resin forming the shell are given below, but others are possible.

Examples of the polar resin include polyester, polycarbonate, phenol resin, epoxy resin, polyamide or cellulose. Polyester is preferred for purposes of material diversity. The polar resin is used in the amount of preferably 0.01 to 20.0 mass parts or more preferably 0.5 to 10.0 mass parts per 100 mass parts of the binder resin.

Examples of the pigment used in the toner of the present invention include the black, yellow, magenta and cyan pigments listed below, as well as dyes as necessary.

A known black colorant can be used as a black colorant. One example is carbon black. In addition, the following yellow, magenta and cyan colorants can also be mixed to make black.

The carbon black is not particular limited, but carbon black prepared by the thermal method, acetylene method, channel method, furnace method, lamp black method or the like can be used.

The number-average primary particle diameter of the carbon black is not particularly limited, but is preferably 14 to 80 nm or more preferably 25 to 50 nm. If the number-average primary particle diameter is less than 14 nm, the toner is likely to exhibit a reddish color, which is not desirable in a black used for full-color image formation. Conversely, if the number-average primary particle diameter of the carbon black exceeds 80 nm, the tinting strength will tend to be low even if dispersal is good.

The number-average primary particle diameter of the carbon black can be measured using an enlarged photograph taken under a scanning electron microscope.

The DBP absorption of the carbon black is not particularly limited, but is preferably 30 to 200 ml/100 g or more preferably 40 to 150 ml/100 g. If the DBP absorption of the carbon black is less than 30 ml/100 g, the tinting strength tends to be low even if dispersal is good. Conversely, if the DBP absorption of the carbon black exceeds 200 ml/100 g, a large quantity of dispersion medium is required when preparing the pigment composition in the toner manufacturing process.

The DBP absorption of the carbon black is the amount of DBP (dibutyl phthalate) absorbed by 100 g of carbon black, and can be measured in accordance with JIS K6217.

The pH of the carbon black is not particularly limited as long as it does not greatly inhibit the effects of the azo compound, and does not interfere with the fixing performance thereby causing fogging, and not deteriorate other properties of the toner.

The pH of the carbon black can be measured with a pH electrode using a mixed solution of the carbon black and distilled water.

The specific surface area of the carbon black is not particularly limited, but is preferably no more than 300 $m^2/g$ or more preferably no more than 100 $m^2/g$. If the specific surface area of the carbon black is greater than 300 $m^2/g$, more of the azo compound will be needed to obtain good dispersibility of the carbon black.

The specific surface area of the carbon black is the BET specific surface area, which can be measured in accordance with JIS K4652.

One kind or a mixture of two or more kinds of carbon black may be used.

The pigment used may be a raw pigment, or may be a prepared pigment as long as it does not greatly inhibit the effects of the azo compound.

A known yellow colorant can be used as a yellow colorant.

Typical examples of pigment-based yellow colorants include condensed azo compounds, isoindolinone compounds, anthraquinone compounds, azo metal complex methine compounds and allylamide compounds. Specific examples are C. I. Pigment Yellow 3, 7, 10, 12, 13, 14, 15, 17, 23, 24, 60, 62, 74, 75, 83, 93, 94, 95, 99, 100, 101, 104, 108, 109, 110, 111, 117, 123, 128, 129, 138, 139, 147, 148, 150, 155, 166, 168, 169, 177, 179, 180, 181, 183, 185, 191:1, 191, 192, 193 and 199. Examples of dye-based yellow colorants include C. I. Solvent Yellow 33, 56, 79, 82, 93, 112, 162 and 163 and C. I. Disperse Yellow 42, 64, 201 and 211.

Of these, C. I. Pigment Yellow 155 and 180 and other condensed azo compounds are preferred because their structures are similar to that of the azo skeleton partial structure of the azo compound of the present invention, giving them good adsorbability of the azo compound. C. I. Pigment Yellow 185 and other isoindoline compound also have good adsorbability and are desirable because the interactions by hydrogen bonding between the pigment and the azo compound of the present invention can be strengthened by appropriately selecting the substituents of the azo compound.

A known magenta colorant can be used as the magenta colorant.

A condensed azo compound, diketopyrrolopyrrole compound, anthraquinone, quinacridone compound, basic dye lake compound, naphthol compound, benzimidazolone compound, thioindigo compound or perylene compound can be used as the magenta colorant. Specific examples are C. I. Pigment Red 2, 3, 5, 6, 7, 23, 48:2, 48:3, 48:4, 57:1, 81:1, 122, 146, 150, 166, 169, 177, 184, 185, 202, 206, 220, 221, 238, 254 and 269 and C. I. Pigment Violet 19.

Of these, C. I. Pigment Red 150 and other condensed azo compounds are preferred because their structures are similar to that of the azo skeleton partial structure of the azo compound of the present invention, giving them good adsorbability of the azo compound. C. I. Pigment Red 122, C. I. Pigment Violet 19 and other quinacridone compounds and the like also have good adsorbability and are desirable because the interactions by hydrogen bonding between the pigment and the azo compound of the present invention can be strengthened by appropriately selecting the substituents of the azo compound.

A known cyan colorant can be used as the cyan colorant.

Phthalocyanine compounds and their derivatives, anthraquinone compounds and basic dye lake compounds can be used as cyan colorants. Specific examples are C. I. Pigment Blue 1, 7, 15, 15:1, 15:2, 15:3, 15:4, 60, 62 and 66.

These colorants can be used alone, mixed, or used in solid solution. In the present invention, a colorant is selected out of considerations of hue angle, brightness, lightness, weather resistance, OHT transparency, and dispersibility in the toner. The added amount of the toner is preferably 1 to 20 mass parts per 100 mass parts of the polymerizable monomer or binder resin.

In the toner of the present invention, the use ratio (by mass) of the pigment and azo compound is preferably 100:0.1 to 100:30, or more preferably 100:0.5 to 100:15.

The toner of the present invention preferably contains a release agent. The total content of the release agent is preferably 2.5 to 25.0 mass parts, more preferably 4.0 to 20 mass parts or still more preferably 6.0 to 18.0 mass parts per 100 mass parts of the toner particles.

The following are examples of the release agent: low-molecular-weight polyethylene, low-molecular-weight polypropylene, microcrystalline wax, Fischer-Tropsch wax, paraffin wax and other aliphatic hydrocarbon waxes; polyethylene oxide wax and other oxides of aliphatic hydrocarbon waxes, or block copolymers of these; carnauba wax, montanoic acid ester wax and other waxes composed principally of aliphatic esters, and deoxidized carnauba wax and others in which the fatty acid esters are partially or fully deoxidized; palmitic acid, stearic acid, montanoic acid and other saturated linear fatty acids; brassidic acid, eleostearic acid, parinaric acid and other unsaturated fatty acids; stearyl alcohol, aralkyl alcohol, behenyl alcohol, carnaubyl alcohol, seryl alcohol, melissyl alcohol and other saturated alcohols; sorbitol and other polyols; linoleic acid amide, oleic acid amide, lauric acid amide and other fatty acid amides; methylene bis-stearamide, ethylene bis-caproamide, ethylene bis-lauramide, hexamethylene bis-stearamide and other saturated fatty acid bis-amides; ethylene bis-oleamide, hexamethylene bis-oleamide, N,N'-dioleyl adipamide, N,N'-dioleyl sebacamide and other unsaturated fatty acid amides; m-xylene bis-stearamide, N,N'-distearyl isophthalamide and other aromatic bis-amides; calcium stearate, calcium laurate, zinc stearate, magnesium stearate and other aliphatic metal salts (those generally called soaps); aliphatic hydrocarbon waxes grafted with styrene, acrylic acid and other vinyl monomers; behenic monoglycerides and other partially esterified products of fatty acids and polyols; and methyl ester compounds with hydroxyl groups obtained by hydrogenation or the like of plant oils and fats.

The toner of the present invention may also use a charge control agent so that the charging performance of the toner can be maintained stably regardless of the environment. The following are examples of charge control agents for negative charge: monoazo metal compounds, acetylacetone metal compounds, aromatic oxycarboxylic acids, aromatic dicarboxylic acids, metal compounds of oxycarboxylic and dicarboxylic acids, aromatic oxycarboxylic acids, aromatic mono- or polycarboxylic acids and their metal salts, anhydrides or esters, bisphenols and other phenol derivatives, urea derivatives, metallized salicylic acid compounds, metallized naphthoic acid compounds, boron compounds, quaternary ammonium salts, calixarene, and resin-based charge control agents.

The following are examples of charge control agents for positive charge: nigrosine and nigrosine denatured with fatty acid metals salts and the like; guanidine compounds; imidazole compounds; tributylbenzyl ammonium-1-hydroxy-4-naphthosulfonic acid salt, tetrabutyl ammonium tetrafluoroborate and other quaternary ammonium salts, phosphonium salts and onium salts that are analogs of these, and lake pigments thereof; triphenylmethane dyes and lake pigments thereof (using phosphotungstic acid, phosphomolybdic acid, phosphotungstenmolybdic acid, tannic acid, lauric acid, gallic acid, ferricyanide, ferrocyanide or the like as the laking agent); metal salts of higher fatty acids; dibutyl tin oxide, dioctyl tin oxide, dicyclohexyl tin oxide and other diorgano-tin oxides; dibutyl tin borate, dioctyl tin borate, dicyclohexyl tin borate and other diorgano-tin borates; and resin-based charge control agents. These may be used alone, or two or more may be combined.

Of these, a metallized salicylic acid compound is desirable as a charge control agent other than a resin-based charge control agent, and one in which the metal is aluminum or zirconium is particularly desirable. An aluminum salicylate compound is particularly desirable as a charge control agent.

Polymers or copolymers having sulfonic acid groups, sulfonic acid salt groups or sulfonic acid ester groups are preferred examples of resin-based charge control agents.

Examples of polymers having sulfonic acid groups, sulfonic acid salt groups or sulfonic acid ester groups include in particular a polymer compound consisting of a styrene and/or styrene (meth)acrylate copolymer that comprises a sulfonic acid group-containing (meth)acrylamide monomer at a copolymerization ratio of at least 2 mass % or preferably at least 5 mass %, and has a glass transition temperature (Tg) of 40 to 90° C., a peak molecular weight of 10,000 to 30,000 and a weight-average molecular weight of 25,000 to 40,000.

The aforementioned sulfonic acid group-containing (meth)acrylamide monomer is preferably represented by General Formula (26) below, and specifically is 2-acrylamido-2-methnylpropanoic acid, 2-methacrylamido-2-methylpropanoic acid or the like.

[C 13]

Formula (26)

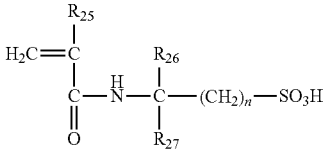

(In Formula (26), $R_{25}$ represents a hydrogen atom or methyl group, $R_{26}$ and $R_{27}$ each independently represent a hydrogen atom or $C_{1-10}$ alkyl, alkenyl, aryl or alkoxy group, and n is an integer from 1 to 10.)

These polymers or copolymers having sulfonic acid groups, sulfonic acid salt groups or sulfonic acid ester groups are highly polar, and in a toner manufactured in an aqueous solvent, they can be localized in the shell to efficiently confer charging characteristics on the toner.

On the other hand, because polymers or copolymers having sulfonic acid groups, sulfonic acid salt groups or sulfonic acid ester groups have low zeta potential, they easily act on C. I. Pigment Red 122 and 150 and the like, which have high zeta potential, causing these pigments to become localized in the surface toner layer, and causing aggregation in some cases. However, the azo compound of the present invention has a strong adsorptive effect on these pigments, a suitable zeta potential, and a small absolute difference in zeta potential with the binder resin. Thus, even when a polymer or copolymer having sulfonic acid groups, sulfonic acid salt groups or sulfonic acid ester groups is used in the toner, it can be dispersed without causing problems such as toner aggregation or localization on the toner surface. As a result, charging performance can be controlled closely with the toner of the present invention.

The preferred compounded amount of the charge control agent is 0.001 to 15.000 mass parts, or more preferably 0.003 to 10.000 mass parts per 100.000 mass parts of the binder resin or polymerizable monomer.

In the toner of the present invention, an inorganic fine powder is preferably added externally to the surface of toner particles manufactured by the suspension polymerization or dissolution suspension method to obtain a toner. That is, an inorganic fine powder is added to and mixed with the toner particles for purposes of improving the flowability and charge uniformity of the toner, and the added inorganic fine powder preferably remains uniformly in an attached state on the surface of the toner particles.

This inorganic fine powder preferably has a number-average particle diameter (D1) of the primary particles of 4 nm to 500 nm.

Examples of the inorganic fine powder used in the present invention include inorganic fine powders selected from silica, alumina and titania, and composite oxides of these. Examples of composite oxides include silica aluminum fine powder, strontium titanate fine powder and the like. These inorganic fine powders are preferably used after hydrophobic surface treatment.

Moreover, other additives such as Teflon®, zinc stearate powder, vinylidene polyfluoride powder and other lubricant powders, or cerium oxide powder, silicon carbide powder, strontium titanate and other polishing agents, anti-caking agents, and reverse polarity organic and or inorganic particles as developing performance improving agents can also be used in the toner of the present invention to the extent that they have no practical adverse effects. These additives may also be given hydrophobic surface treatment.

The toner of the present invention can be applied to image-forming methods using known one-component and two-component developing systems.

The measurement methods used in the present invention are explained below.

(Method of Measuring Zeta Potential of Azo Compound and Binder Resin)

The zeta potentials of the azo compound and binder resin were measured as follows.

The azo compound was synthesized with a weight-average particle diameter of 10 μm to 50 μm. The binder resin was prepared as 5 μm to 10 μm particles by the same methods used to manufacture the toner except that all the raw materials other than the binder resin were excluded. With the azo compound and binder resin, samples may also be prepared by coarse pulverization after bulk polymerization and synthesis, such as for example by pulverizing to about 5 μm to 50 μm by frost shattering with liquid nitrogen, using a Japan Analytical Industry Co., Ltd. Cryogenic Sample Crusher (Model JFC-300). The zeta potentials of the charge control resin and the polyester resin forming the shell layer in the examples and comparative examples below were also measured after the resin had been frost shattered to a size of about 5 μm to 50 μm.

The zeta potentials of the pigments used in the following examples and comparative examples were measured as is.

(Zeta Potential Measurement Procedures)

A Nano-Zs Zetasizer (Sysmex Corp.) was used for measuring zeta potential. 1 mg of measurement sample was added to 5 ml of methanol at 25° C., and dispersed for 3 minutes with an ultrasound disperser (Nippon Rikagaku Kikai Co., Ltd.) to prepare a liquid dispersion. When white sediment or floating matter was visible in the measurement sample, the amount of sample added to the methanol was adjusted appropriately in the liquid dispersion. This dispersion was added with a dropper to a DTS1060C-Clear Disposable Zeta Cell, taking care to avoid air bubbles. This cell was mounted on the aforementioned measurement device, and zeta potential was measured at 25° C. This measurement was performed 5 times, and the arithmetic mean was taken as the zeta potential in the present invention.

(Method of Measuring Adsorbability of Azo Compound by Pigment)

The adsorbability of the azo compound by the pigment was measured as follows.

(Preparation of Calibration Curve)

(A) 300 ml of a "liquid medium and azo compound solution" was prepared with the liquid medium:azo compound mass ratio of a colorant composition, polymerizable monomer composition or toner composition having the formula of an actual manufactured toner (except that the azo compound was added in an amount corresponding to 10 mass % of the colorant). This solution was added to a mayonnaise jar (mayonnaise 450: Nihon Yamamura Glass Co., Ltd.), and shaken for 10 hours with a paint shaker (Toyoseiki) (Solution 1). The liquid medium was then added to the Solution 1 to prepare solutions diluted to azo compound content ratios of 1/5 and 1/10 (hereunder called Solution 2 and Solution 3, respectively).

(B) Solutions 1, 2 and 3 were left standing for 24 hours at 25° C., and filtered with a 0.2 μm pore diameter solvent-resistant membrane filter to obtain sample solutions, the azo compound was measured by GPC under the following conditions, and a calibration curve of azo compound concentration (g/ml) in the liquid medium was prepared.

High-speed GPC Unit: "HLC-8220GPC" (Tosoh Corp.)
Column: LF-804 (2)
Eluent: THF
Flow rate: 1.0 ml/min
Oven temperature: 40° C.
Sample injection amount: 0.025 ml (Measurement of Adsorption Rate)

(A) 300 ml of a "liquid medium and azo compound solution" was prepared with the liquid medium:azo compound mass ratio of a colorant composition, polymerizable monomer composition or toner composition prepared having the formula an actual manufactured toner (except that the azo compound was added in an amount corresponding to 10 mass % of the colorant). This solution was added to a mayonnaise jar (mayonnaise 450: Nihon Yamamura Glass Co., Ltd.), and shaken for 10 hours with a paint shaker (Toyoseiki) (Solution 4). After preparation, the Solution 4 was left standing for 24 hours at 25° C., and centrifuged under the following conditions.

High-speed centrifuge: Kokusan H-9R
Centrifuge tube: PPT-010
Sample: Composition added to about 80% of the capacity of the centrifuge tube
Centrifugation conditions: 3 min., 10,000 rpm (25° C.)

(B) The supernatant of the centrifuged composition was collected and filtered with a filter (Nihon Millipore Mirex LH, pore diameter 0.45 μm, diameter 13 mm), and the concentration of the azo compound in the supernatant was measured by GPC under the same conditions used for the calibration curve.

(C) The adsorption rate (%) was calculated by the following formula from the measurement results above.

Adsorption rate (%)={azo compound concentration (g/1 ml liquid medium) in Solution 1−azo compound concentration (g/1 ml liquid medium) in supernatant of Solution 4}/{azo compound concentration (g/1 ml liquid medium) in Solution 1}×100

(Method of Measuring Acid Value of Azo Compound)

The acid value of the azo compound was measured as follows.

The number of milligrams of potassium hydroxide required for neutralizing resin acids and the like in 1 g of sample was given as the acid value.

The acid value was measured in accordance with JIS K 0070-1992, and specifically was measured by the following procedures.

(1) Preparation of Reagents 1.0 g of phenolphthalein was dissolved in 90 ml of ethyl alcohol (95 vol %), and ion exchange water was added to 100 ml to give a phenolphthalein solution.

7 g of special grade potassium hydroxide was dissolved in 5 ml of water, and ethyl alcohol (95 vol %) was added to a total of 1 liter. This was placed in an alkali resistant container while avoiding contact with carbon dioxide gas and the like, left for 3 days, and filtered to obtain a potassium hydroxide solution. The resulting potassium hydroxide solution was stored in the alkali resistant container. The factor of the potassium hydroxide solution was determined by taking 25 ml of 0.1 mole/liter hydrochloric acid in a triangular flask, adding a few drops of the phenolphthalein solution, titrating with the potassium hydroxide solution, and determining the amount of potassium hydroxide solution required for neutralization. The 0.1 mole/liter hydrochloric acid was prepared in accordance with JIS K 8001-1998.

(2) Operations (A) Main Test 2.0 g of sample was weighed exactly in a 200 ml triangular flask, 100 ml of a mixed toluene/ethanol (2:1) solution was added, and the sample was dissolved for 5 hours. Next, a few drops of the aforementioned phenolphthalein solution were added as an indicator, and the mixture was titrated with the aforementioned potassium hydroxide solution. The titration end point was determined after the indicator maintained a light pink color for about 30 seconds.

(B) Blank Test

Titration was performed by the same operations as above except that no sample was used (that is, using only a toluene/ethanol (2:1) mixed solution).

(3) The acid value was calculated by substituting the results in the following formula.

$$A=[(C-B)\times f\times 5.61]/S$$

In the formula, A is the acid value (mgKOH/g), B is the added amount of potassium hydroxide solution in the blank test (ml), C is the added amount of potassium hydroxide solution in the main test (ml), f is the factor of the potassium hydroxide solution, and S is the sample (g).

(Method of Measuring Number-Average Molecular Weights (Mn) of Polymer Component and Azo Compound)

In the present invention, the number-average molecular weights of the polymer component and azo compound were calculated as polystyrene equivalents by size exclusion chromatography (SEC). Molecular weight measurement by SEC was performed as follows.

The sample was added to tetrahydrofuran (THF) to a sample concentration of 1.0%, and left for 24 hours at room temperature, and the resulting solution was filtered with a solvent resistant membrane filter with a pore diameter of 0.2 μm to obtain a sample solution, which was measured under the following conditions.

Equipment: High-speed GPC Unit "HLC-8220GPC" (Tosoh Corp.)
Column: LF-804 (2)
Eluent: THF
Flow rate: 1.0 ml/min
Oven temperature: 40° C.
Sample injection amount: 0.025 ml A molecular weight calibration curve prepared with standard polystyrene resins (Tosoh Corp. TSK Standard Polytstyrene F-850, F-450, F-288, F-128, F-80, F-40, F-20, F-10, F-4, F-2, F-1, A-5000, A-2500, A-1000, A-500) was used in calculating the molecular weight of the sample.

(Method of Measuring Weight-Average Particle Diameter (D4) and Number-Average Particle Diameter (D1) of Toner)

The weight-average particle diameter (D4) and number-average particle diameter (D1) of the toner can be measured by various methods, such as with a TA-III Coulter Counter or Coulter Multisizer (Coulter Co.). In the present invention, the number distribution and weight distribution were calculated using a TA-III Coulter Counter (Coulter Co.). The weight-average particle diameter (D4) and number-average particle diameter (D1) of the toner were calculated as follows. A precision particle size distribution measurement unit "Coulter Counter Multisizer 3" (trade name, Beckman-Coulter) using the pore electrical resistance method and equipped with a 100 μm aperture tube was used as the measurement device. The attached dedicated software "Beckman-Coulter Multisizer 3 Version 3.51" (Beckman-Coulter) was used to set the measurement conditions and analyze the measurement data. Measurement was performed with 25,000 effective measurement channels.

The aqueous electrolyte solution used in measurement is one comprising special grade sodium chloride dissolved in ion exchange water so as to obtain a concentration of about 1 mass %, such as "ISOTON II" (Beckman-Coulter).

The dedicated software is set as follows prior to measurement and analysis.

On the "CHANGE STANDARD OPERATION METHOD (SOM)" screen of the dedicated software, the total count number in control mode is set to 50,000, the number of measurements is set to 1, and the Kd value is set to a value obtained using "10.0 μm standard particles" (Beckman-Coulter). The threshold and noise level are set automatically by pushing the "THRESHOLD/NOISE LEVEL MEASUREMENT BUTTON". The current is set to 1600 μA, the gain to 2 and the electrolyte to ISOTON II, and the "APERTURE FLUSH AFTER MEASUREMENT" box is checked.

On the "PULSE-PARTICLE SIZE CONVERSION SETTING" screen of the dedicated software, the bin interval is set to the logarithmic particle diameter, the particle diameter bins are set to 256 particle diameter bins, and the particle diameter range is set from 2 μm to 60 μm.

The specific measurement methods are as follows.

(1) About 200 ml of the aforementioned aqueous electrolyte solution is placed in a dedicated 250 ml round-bottomed glass beaker for the Multisizer 3, set on a sample stand, and stirred counter-clockwise with a stirrer rod at 24 rotations/second. Contaminants and air bubbles in the aperture tube are then removed by the "APERTURE FLUSH" function of the dedicated software.

(2) About 30 ml of the aforementioned aqueous electrolyte solution is placed in a 100 ml glass flat-bottomed beaker. About 0.3 ml of a diluted solution of "Contaminon N" (a pH 7 aqueous 10 mass % solution of a neutral detergent for cleaning precision measuring equipment, containing a non-ionic surfactant, an anionic surfactant and an organic builder, manufactured by Wako Pure Chemical Industries, Ltd.) as a dispersant diluted about 3 times by mass with ion exchange water is then added.

(3) An ultrasound disperser "Ultrasonic Dispersion System Tetora 150" (manufactured by Nikkaki Bios Co., Ltd.) is prepared housing two oscillators with an oscillation frequency of 50 kHz with the phases shifted by 180° and having an electrical output of 120 W. A predetermined amount of ion exchange water is supplied to the water vessel of the ultrasound disperser, and about 2 ml of the aforementioned Contaminon N is then added to the water vessel.

(4) The beaker from (2) above is set in the beaker-fixing hole of the ultrasound disperser, and the ultrasound disperser is operated. The height level of the beaker is then adjusted so as to maximize the resonant condition of the liquid surface of the aqueous electrolyte solution in the beaker.

(5) While the aqueous electrolyte solution in the beaker of (4) above is being exposed to ultrasound, about 10 mg of toner is added little by little to the aqueous electrolyte solution, and dispersed. To confirm granulation of the toner particles, the toner particle suspension after completion of the polymerization reaction (in the suspension polymerization method) or the granulated toner suspension (in the dissolution suspension method) is added little by little to the aqueous electrolyte solution, and dispersed. Ultrasound dispersion treatment is then continued for a further 60 seconds. During ultrasound dispersion, the temperature of the water vessel is adjusted appropriately to be 10° C. to 40° C.

(6) Using a pipette, the electrolyte aqueous solution of (5) with the toner dispersed therein is dripped into the round-bottomed beaker of (1) set in the sample stand, and adjusted to a measurement concentration of about 5%. Measurement is continued until the number of measured particles reaches 50,000.

(7) The measurement data is analyzed with the dedicated software attached to the apparatus to computationally obtain a weight-average particle diameter (D4) and number-average particle diameter (D1). Note that the "average diameter" on the "ANALYSIS/WEIGHT STATISTIC (ARITHMETIC AVERAGE)" screen is the weight-average particle diameter (D4) when graph/vol % is set in the dedicated software, while the "average diameter" on the on the "ANALYSIS/NUMBER STATISTIC (ARITHMETIC AVERAGE)" screen is the number-average particle diameter (D1) when graph/number % is set in the dedicated software.

The granulating properties in the granulation step of toner manufacture were investigated by looking at the D50 wt %/D50 number % as measured with the Coulter Counter. D50 wt %/D50 number % represents the 50% particle diameter based on weight distribution divided by the 50% particle diameter based on numerical distribution.

EXAMPLES

Examples of the present invention are explained in detail below, but these do not limit the present invention in any way. "Parts" and "%" in the examples and the like below are based on mass unless otherwise specified.

Manufacturing examples of the azo compound used in the present invention are discussed.

Manufacturing Example

Azo Compound Polymer Component (A-1)

100.00 mass parts of propylene glycol monomethyl ether were heated with nitrogen substitution and refluxed at a liquid temperature of 120° C. or more, and a mixture of 159.00 mass parts of styrene, 36.00 mass parts of butyl acrylate, 10.00 mass parts of acrylic acid (styrene/acrylic acid/butyl acrylate=11.00/1.00/2.00 (molar ratio)) and 1.25 mass parts of tert-butyl peroxybenzoate (organic peroxide polymerization initiator, NOF Corp., Perbutyl Z®) were dripped in over the course of 3 hours. After completion of dripping, the solution was agitated for 3 hours, distilled at normal pressure as the liquid temperature was raised to 170° C., and once the liquid temperature reached 170° C., was distilled under reduced pressure of 1 hPa for 1 hour to remove the solvent and obtain a resin solid. The solid was dissolved in tetrahydrofuran and re-precipitated with n-hexane, and the precipitated solid was filtered out to obtain a polymer component (A-1). The physical properties of the resulting polymer component (A-1) are shown in Table 1.

Manufacturing Examples

Azo Compound Polymer Components (A-2) to (A-10)

Polymer components (A-2) to (A-10) were manufactured in the same way as the polymer component (A-1) except that the types and compositional ratios of the polymerizable monomers were changed as shown in Table 1. The physical properties of the resulting polymer components (A-2) to (A-10) are shown in Table 1.

Manufacturing Example

Azo Compound Polymer Component (A-11)

A resin (A-11) containing monomer units represented by Formula (7) above (in which $L_2$ is a p-phenylene group) and monomer units represented by Formula (10) above (in which $R_{24}$ is an ethylene group and x and y are both 1) was manufactured by the following methods.

In a four-necked flask, 31.60 g of oxyethylenated bisphenol A, 14.80 g of terephthalic acid, 5.50 g of glycerin as a crosslinking agent and 0.5 mg of di-n-butyl tin oxide as a catalyst were heat melted and agitated at 200° C. with nitrogen gas introduced as an inactive gas. After the outflow of water as a by-produced ceased, the temperature was raised to 230° C. over the course of about 1 hour, the mixture was agitated with heating for 2 hours, and the resin was extracted in a molten state. This was cooled to normal temperature, and water washed to obtain a polymer component (A-11). The physical properties of the resulting polymer component (A-11) are shown in Table 1.

TABLE 1

| | Compositional ratios | | | | | |
|---|---|---|---|---|---|---|
| No. | St: styrene | AA: acrylic acid | AAM: Acryl-amide | BA: Butyl acrylate | Molecular weight Mn | Acid value (mgKOH/g) |
| A-1 | 11.00 | 1.00 | 0.00 | 2.00 | 15000 | 30.1 |
| A-2 | 11.00 | 1.00 | 0.02 | 0.60 | 14600 | 31.9 |
| A-3 | 11.00 | 1.00 | 0.08 | 0.60 | 15100 | 32.0 |
| A-4 | 11.00 | 1.00 | 0.10 | 0.60 | 15700 | 32.3 |
| A-5 | 13.00 | 1.00 | 0.00 | 0.60 | 16000 | 34.5 |
| A-6 | 10.00 | 1.00 | 0.00 | 0.60 | 15500 | 37.8 |
| A-7 | 7.50 | 1.00 | 0.00 | 0.60 | 15000 | 41.1 |
| A-8 | 9.78 | 0.11 | 0.00 | 0.11 | 15700 | 32.0 |
| A-9 | 8.00 | 1.00 | 0.33 | 0.06 | 15200 | 54.8 |
| A-10 | 7.50 | 1.00 | 0.52 | 0.06 | 15000 | 59.0 |
| A-11 | — | — | — | — | 3545 | 11.6 |

Manufacturing Example

Azo Compound 1

A compound (B-1) having the azo skeleton partial structure represented by Formula (6) above was manufactured according to the following scheme.

[C 14]

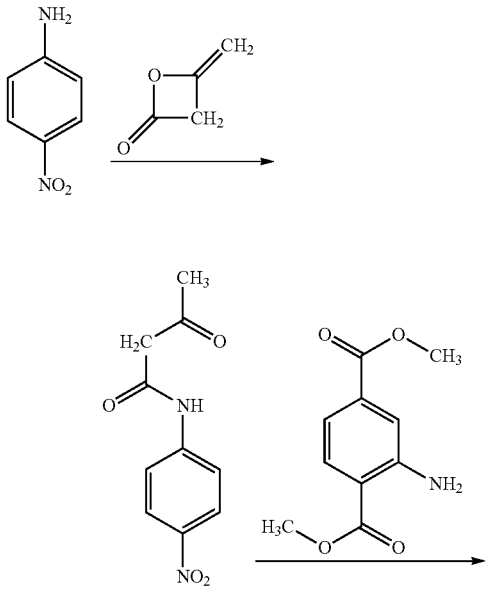

(27)

-continued

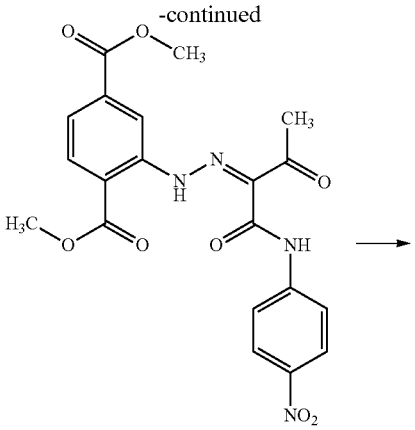

(28)

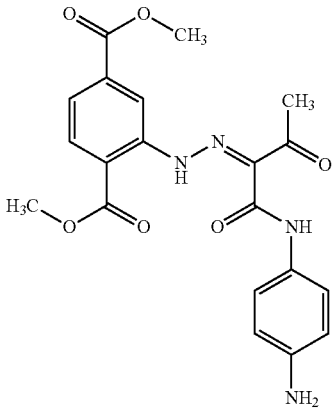

(B-1)

First, 3.11 mass parts of 4-nitroaniline (Tokyo Chemical Industry Co., Ltd.) were added to 30 mass parts of chloroform, and ice cooled to 10° C. or less, and 1.89 mass parts of diketen (Tokyo Chemical Industry Co., Ltd.) were added. This was then agitated for 2 hours at 65° C. After completion of the reaction, the chloroform was extracted to obtain a concentration Compound (27).

Next, 40.00 mass parts of methanol and 5.29 mass parts of concentrated hydrochloric acid were added to 4.25 mass parts of dimethyl 2-aminoterephthalate (Merck Japan), and ice cooled to 10° C. or less. 2.10 mass parts of sodium nitrite dissolved in 6.00 mass parts of water was added to this solution, and reacted for 1 hour at the same temperature. Then 0.990 mass parts of sulfamic acid were added and agitated for a further 20 minutes (diazonium salt solution). 4.51 mass parts of Compound (27) were added to 70.00 mass parts of methanol, ice cooled to 10° C. or less, and added to the diazonium salt solution. A solution of 5.83 mass parts of sodium acetate dissolved in 7.00 mass parts of water was then added, and reacted for 2 hours at 10° C. or less. After completion of the reaction, 300.00 mass parts of water were added and agitated for 30 minutes, and the solids were filtered out and purified by recrystallization from N,N-dimethylformamide to obtain a Compound (28). 8.58 mass parts of the Compound (28) and 0.40 mass parts of palladium-active carbon (palladium 5%) were next added to 150.00 mass parts of N,N-dimethylformamide, and agitated for 3 hours at 40° C. in a hydrogen gas atmosphere (reaction pressure 0.1 to 0.4 MPa). After completion of the reaction, the solution was filtered to obtain a concentrated Compound (B-1).

Next, the amino groups of the Compound (B-1) (azo skeleton partial structure) and the carboxyl groups of the polymer component (A-1) are bound together by amidation to manufacture an Azo compound 1 according to the following scheme:

[C 15]

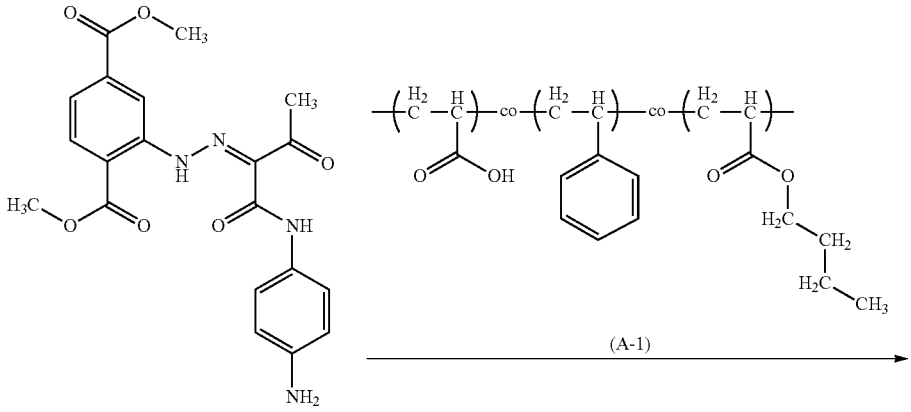

(B-1)

-continued

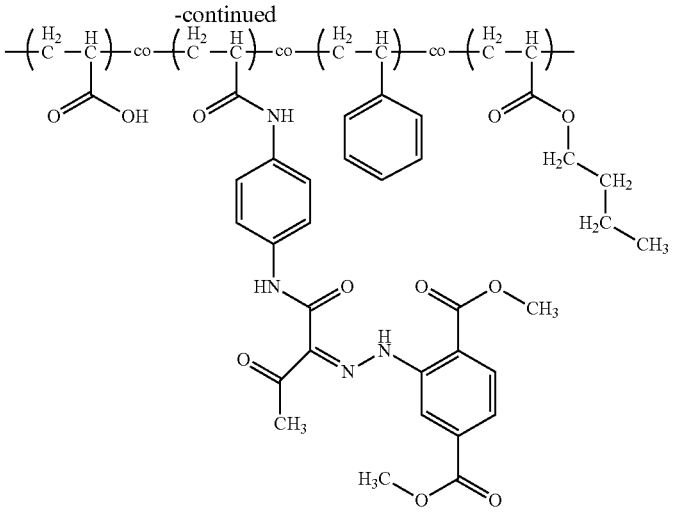

(Azo compound 1)

(in the structural formulae above, "co" is a symbol indicating that the sequences of the monomer units making up the copolymer are not ordered).

First, 1.89 mass parts of the Compound (B-1) were added to 500.00 mass parts of tetrahydrofuran, and dissolved by heating to 80° C. After dissolution the temperature was lowered to 50° C., 15.00 mass parts of the polymer component (A-1) were added and dissolved, and 1.96 mass parts of 1-ethyl-3-(3-dimethylaminopropyl) carbodiimide hydrochloride (EDC HCl) were added and agitated for 5 hours at 50° C., after which the liquid temperature was gradually returned to room temperature, and the reaction was completed by agitating overnight. After completion of the reaction, the solution was concentrated by filtration, and purified by re-precipitation with methanol to obtain an azo compound 1. The physical characteristics of the azo compound are shown in Table 2.

Manufacturing Example

Azo Compound 2

An azo compound 2 was obtained in the same way as the azo compound 1 except that (B-2) below was substituted for the (B-1) used in manufacturing the azo compound 1. The physical characteristics of the azo compound 2 are shown in Table 2.

[C 16]

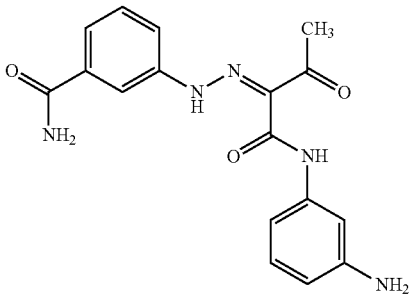

(B-2)

Manufacturing Example

Azo Compound 3

An azo compound 3 represented by the following structure was manufactured according to the following scheme:

[C 17]

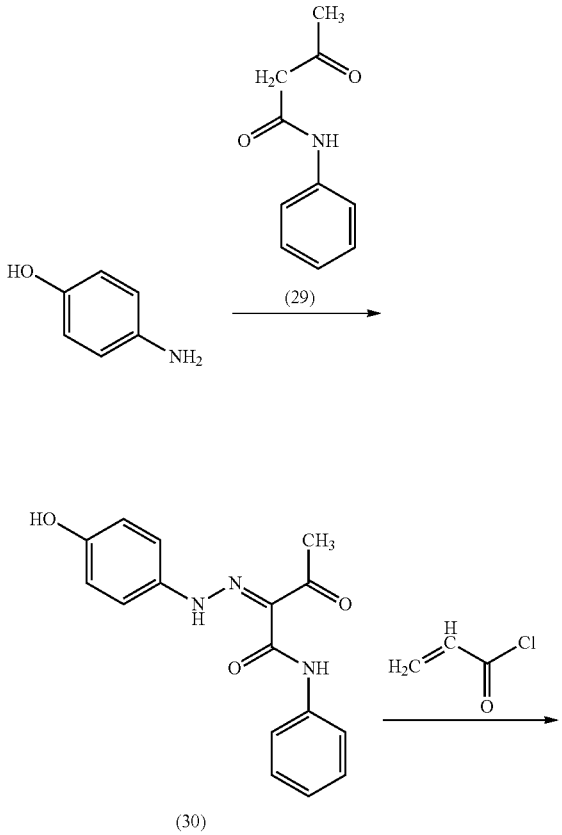

(29)

(30)

-continued

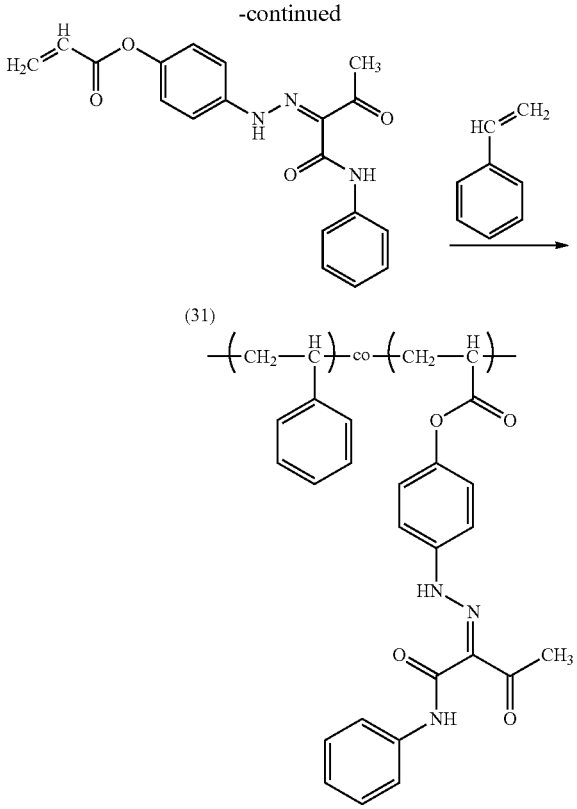

(31)

(Azo compound 3)

(in the scheme, "co" is a symbol indicating that the sequences of the monomer units making up the copolymer are not ordered).

First, 30.0 mass parts of water and 11.0 mass parts of concentrated hydrochloric acid were added to 5.00 mass parts of 4-aminophenol (Tokyo Chemical Industry Co., Ltd.), and ice cooled to 10° C. or less. 3.46 mass parts of sodium nitrite dissolved in 8.10 mass parts of water were added to this solution, and reacted for 1 hour at the same temperature. 0.657 mass parts of sulfamic acid was then added and agitated for a further 20 minutes (diazonium salt solution). 8.13 mass parts of acetoacetoanilide (Tokyo Chemical Industry Co., Ltd.) were added to 48.0 mass parts of water, and ice cooled to 10° C. or less, and the aforementioned diazonium salt solution was added. Next, 14.30 mass parts of sodium carbonate dissolved in 80.00 mass parts of water were added, and reacted for 2 hours at 10° C. or less. After completion of the reaction, 50.00 mass parts of water were added and agitated for 30 minutes, and the solids were filtered out and purified by re-crystallization from N,N-dimethylformamide to obtain a Compound (30).

Next, 3.00 mass parts of the Compound (30) and 1.20 mass parts of triethylamine were added to 30.00 mass parts of chloroform, and ice cooled to 10° C. or less. 1.03 mass parts of acryloyl chloride (Tokyo Chemical Industry Co., Ltd.) were added to this solution, and reacted for 20 minutes at the same temperature. This was extracted with chloroform, concentrated, and purified to obtain a Compound (31).

Next, 9.44 mass parts of N,N-dimethylformamide, 1.06 mass parts of the Compound (31) and 0.327 mass parts of azobisisobutyronitrile were added to 10 mass parts of styrene, and agitated for 2 hours at 80° C. in a nitrogen atmosphere. After completion of the reaction, this was purified by re-crystallization from N,N-dimethylformamide to obtain an azo compound 3. The physical properties of the azo compound are shown in Table 2.

Manufacturing Example

Azo Compound 4

An azo compound 4 was obtained by the same methods as the azo compound 3 except that the substituents in azo compound 3 were changed as shown in Table 2. The material values of the azo compound 4 are shown in Table 2.

Manufacturing Example Azo Compound 5

An azo compound 5 was obtained by the same methods as the azo compound 1 except that the substituents in azo compound 1 were changed as shown in Table 2. The material values of the azo compound 5 are shown in Table 2.

Manufacturing Examples

Azo Compounds 6 to 8

Azo compounds 6 to 8 were obtained by the same methods as the azo compound 1 except that the substituents and polymer component in azo compound 1 were changed as shown in Table 2. The material values of the azo compounds 6 to 8 are shown in Table 2.

Manufacturing Examples

Azo Compounds 9 to 11

Azo compounds 9 to 11 were obtained by the same methods as the azo compound 1 except that the substituents and polymer component in azo compound 1 were changed as shown in Table 2. The material values of the azo compounds 9 to 11 are shown in Table 2.

Manufacturing Example

Azo Compound 12

In manufacturing an azo compound, an azo compound 12 was obtained in the same way as the azo compound 1 except that (B-3) below was substituted for (B-1). The material values of the azo compound 12 are shown in Table 2 below.

[C 18]

(B-3)

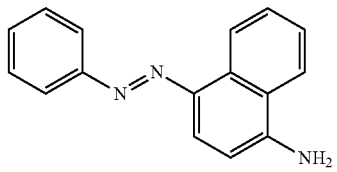

Manufacturing Examples

Azo Compounds 13 and 14

Azo compounds 13 and 14 were obtained in the same way as the azo compound 1 except that the substituents and polymer component in the azo compound 1 were changed as shown in Table 2. The material values of the azo compounds 13 and 14 are shown in Table 2.

Manufacturing Examples

Azo Compounds 15 and 16

Azo compounds 15 and 16 were obtained in the same way as the azo compound 1 except that the substituents and polymer component in the azo compound 1 were changed as shown in Table 2. The material values of the azo compounds 15 and 16 are shown in Table 2.

Manufacturing Examples

Azo Compounds 17 to 23

Azo compounds 17 to 23 were obtained in the same way as the azo compound 1 except that the substituents in the azo compound 1 were changed as shown in Table 2. The material values of the azo compounds 17 to 23 are shown in Table 2.

Manufacturing Example

Azo Compound 24

1.27 mass parts of the Compound (B-1) were added to 200.00 mass parts of dehydrated tetrahydrofuran, and dissolved by heating to 80° C. After dissolution the temperature was lowered to 50° C., 18.8 mass parts of the resin (A-11) dissolved in 30 mass parts of dehydrated tetrahydrofuran were added, 3.00 mass parts of 1-ethyl-3-(3-dimethylaminopropyl)carbodiimide hydrochloride (EDC HCl) were added, and the mixture was agitated for 5 hours at 50° C. The liquid temperature was gradually returned to room temperature, and the reaction was completed by agitating overnight. After completion of the reaction, the solution was concentrated and extracted with chloroform, the organic phase was water washed, and the solution was concentrated and purified by re-precipitation with methanol to obtain an azo compound 24. The material values of the azo compound 24 are shown in Table 2.

Manufacturing Example

Azo Compound 25

The following azo compound 25 was manufactured according to the following scheme.

[C 19]

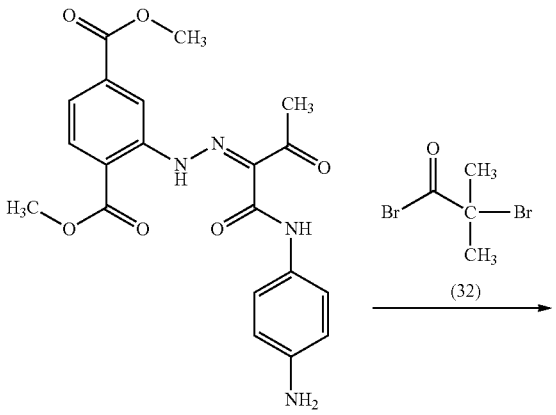

(B-1)

-continued

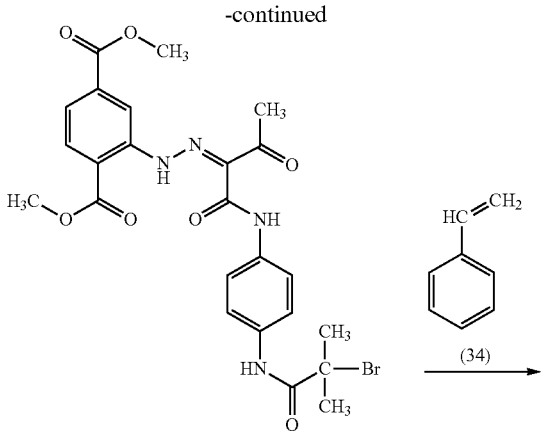

(33)

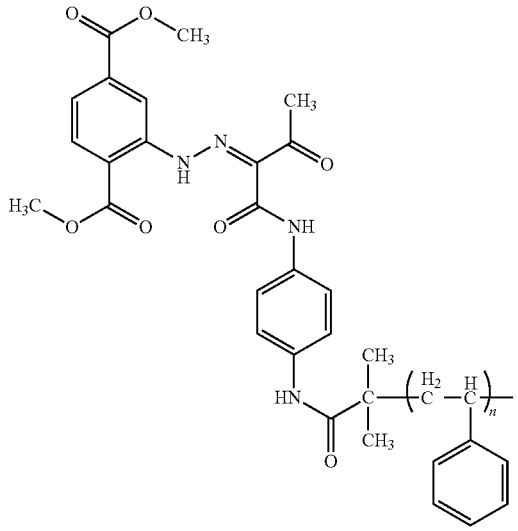

(Azo compound 25)

5.00 mass parts of the Compound (B-1) and 1.48 mass parts of triethylamine were added to 25.00 mass parts of chloroform and ice cooled to 10° C. or less, and 2.07 mass parts of the compound (32) were added. This was then agitated for 6 hours at room temperature. After completion of the reaction, this was extracted with chloroform, and concentrated to obtain 5.35 mass parts of a compound (33) (yield 97.3%).

Next, 2.50 mass parts of the compound (33), 140.00 mass parts of styrene (34), 1.77 mass parts of N,N,N',N'',N''-pentamethyldiethylene triamine and 0.64 mass parts of copper (I) bromide were added to 50.0 mass parts of N,N-dimethylformamide. This was then agitated for 45 minutes at 120° C. in a nitrogen gas atmosphere. After completion of the reaction this was extracted with chloroform, and purified by re-precipitation with methanol to obtain 86.20 mass parts of an azo compound 25. The material values of the azo compound 25 are shown in Table 2.

TABLE 2

| | Azo skeleton partial structure | | | | | | | Polymer | Zeta potential | Acid value |
|---|---|---|---|---|---|---|---|---|---|---|
| | R1 | R2 | R16 | R17 | R18 | R19 | R20 | component | (mV) | (mgKOH/g) |
| Azo Compound 1 | $CH_3$ | $R_2$-1 | H | $COOCH_3$ | H | H | $COOCH_3$ | A-1 | 0 | 7.2 |
| Azo compound 2 | $CH_3$ | $R_2$-2 | H | H | H | $CONH_2$ | H | A-1 | 1 | 0.1 |
| Azo compound 3 | $CH_3$ | NHPh | H | H | Ar-1 | H | H | — | 0 | 0.1 |
| Azo compound 4 | $CH_3$ | $NHCH_3$ | $CH_3$ | $CH_3$ | Ar-1 | H | H | — | 0 | 0.3 |
| Azo compound 5 | $CH_3$ | $R_2$-2 | H | H | H | $CH_3$ | H | A-1 | 0 | 0.2 |
| Azo compound 6 | $CH_3$ | $R_2$-2 | H | H | H | $CONH_2$ | H | A-2 | 5 | 0.1 |
| Azo compound 7 | $CH_3$ | $R_2$-2 | H | H | H | $CONH_2$ | H | A-3 | 12 | 0.2 |
| Azo compound 8 | $CH_3$ | $R_2$-2 | H | H | H | $CONH_2$ | H | A-4 | 15 | 0.1 |
| Azo compound 9 | $CH_3$ | $R_2$-2 | H | H | H | $CONH_2$ | H | A-5 | −31 | 10.2 |
| Azo compound 10 | $CH_3$ | $R_2$-2 | H | H | H | $CONH_2$ | H | A-6 | −38 | 12.9 |
| Azo compound 11 | $CH_3$ | $R_2$-2 | H | H | H | $CONH_2$ | H | A-7 | −46 | 15.9 |
| Azo compound 12 | — | — | — | — | — | — | — | A-1 | 1 | 0.1 |
| Azo compound 13 | $CH_3$ | $R_2$-2 | H | $COOCH_3$ | H | H | $CH_3$ | A-1 | 0 | 0.1 |
| Azo compound 14 | $CH_3$ | $CH_3$ | $CH_3$ | $CH_3$ | Ar-1 | H | H | A-8 | 0 | 0.2 |
| Azo compound 15 | $CH_3$ | $R_2$-2 | H | H | H | $CONH_2$ | H | A-9 | −10 | 29.8 |
| Azo compound 16 | $CH_3$ | $R_2$-2 | H | H | H | $CONH_2$ | H | A-10 | −15 | 33 |
| Azo compound 17 | $CH_3$ | $R_2$-2 | H | $CONH_2$ | H | H | $OCH_3$ | A-1 | 1 | 0.1 |
| Azo compound 18 | $CH_3$ | $R_2$-2 | H | $CONH_2$ | H | H | $CH_3$ | A-1 | 4 | 0.1 |
| Azo compound 19 | $CH_3$ | $R_2$-2 | H | H | $CONHCH_3$ | H | H | A-1 | 1 | 0.2 |
| Azo compound 20 | $CH_3$ | $R_2$-2 | H | H | H | H | $CONH_2$ | A-1 | 4 | 0.1 |
| Azo compound 21 | $CH_3$ | $R_2$-2 | H | COOH | H | H | $COOCH_3$ | A-1 | −3 | 0.2 |
| Azo compound 22 | $CH_3$ | $R_2$-2 | H | H | H | $COOCH_3$ | H | A-1 | 0 | 0.1 |
| Azo compound 23 | $CH_3$ | $R_2$-2 | H | H | $COOCH_2CH_2CH_3$ | H | H | A-1 | 0 | 0.1 |
| Azo compound 24 | $CH_3$ | $R_2$-3 | H | $COOCH_3$ | H | H | $COOCH_3$ | A-11 | −5 | 0.1 |
| Azo compound 25 | $CH_3$ | $R_2$-4 | H | $COOCH_3$ | H | H | $COOCH_3$ | — | 0 | 0 |

In table, "ph" represents a phenyl group

The azo skeleton structures shown in Table 2 above are explained below.

[C 20]

General formula (W1)

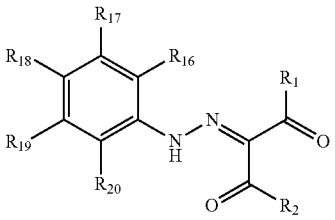

(in Formula (W1), $R_1$, $R_2$ and $R_{16}$ to $R_{20}$ each represent a substituent shown in Table 2. Ar-1 and $R_2$-1 to $R_2$-4 represent the following structures.)

[C 21]

(Ar-1)

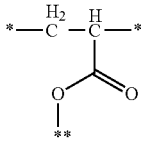

-continued ($R_2$-1)

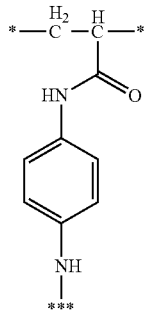

($R_2$-2)

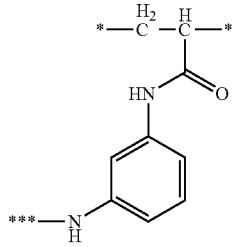

($R_2$-3)

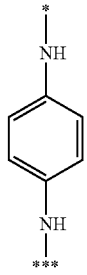

-continued ($R_2$-4)

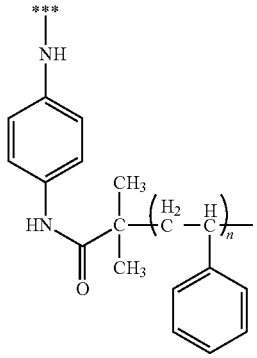

("*" in Ar-1, $R_2$-1 and $R_2$-2 above represents incorporation by chemical bonding into the polymer component, and bonding with the polymer. "*" in $R_2$-3 represents a site of bonding with a carbon atom of a carboxyl group derived from a polyester polymer component. "" or "*" represents bonding with "" or "*" in the following General Formula.)

[C 22]

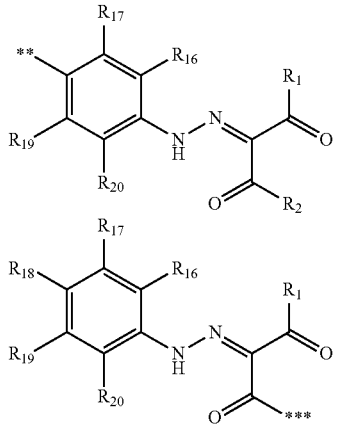

Manufacturing Example

Resin-Based Charge Control Agent 1 (Copolymer Having Sulfonic Acid Group))

250 mass parts of methanol as a solvent, 150 mass parts of 2-butanone and 100 mass parts of 2-propanol were added to pressurizable reaction container provided with a convection tube, a stirrer, a thermometer, a nitrogen introduction pipe, a dripping device and a depressurization device, and 77 mass parts of styrene, 15 mass parts of 2-ethylhexyl acrylate and 8 mass parts of 2-acrylamido-2-methylpropane sulfonic acid as monomers were added and heated with agitation to the convection temperature. A solution of 1 mass part of the polymerization initiator t-butylperoxy-2-ethylhexanoate diluted with 20 mass parts of 2-butanone was dripped in over the course of 30 minutes, and agitation was continued for 5 hours. A further solution of 1 mass part of t-butylperoxy-2-ethylhexanoate dissolved in 20 mass parts of 2-butanone was dripped in over the course of 30 minutes, and agitated for 5 hours to complete polymerization. The temperature was maintained as 500 mass parts of deionized water were added, and this was agitated for 2 hours at 80 to 100 rotations per minute so as not to disturb the boundary between the organic layer and the water layer. After 30 minutes of still standing to separate the layers, the water layer was discarded and anhydrous sodium sulfate was added to dehydrate the organic layer. Next, a polymer obtained by removing the polymerization solvent under reduced pressure was coarsely pulverized to 100 μm or less with a cutter mill equipped with a #150 mesh screen. The resulting resin-based charge control resin 1 having sulfur atoms had a Tg of 58° C., a Mp of 13,000 and a Mw of 30,000.

Manufacturing Example

Black Toner Particles 1

20.0 mass parts of carbon black: NIPEX 35 (Orion Engineered Carbons Co., zeta potential −14 mV), 1 mass part of the azo compound 1 and 3.0 mass parts of a di-tert-butyl salicylic acid aluminum compound "Bontron E88" (Orient Chemical Industries Co., Ltd.) were prepared per 100 mass parts of styrene monomer. These were introduced into an attritor (Mitsui Mining), and agitated for 180 minutes at 25° C., 200 rpm with zirconia beads (140 mass parts) with a radius of 1.25 mm to prepare a master batch dispersion 1.

Meanwhile, 450 mass parts of an 0.1 M-$Na_3PO_4$ aqueous solution were added to 710 mass parts of ion exchange water and heated to 60° C., and 66.7 mass parts of 1.0 M-$CaCl_2$ aqueous solution were gradually added to obtain an aqueous medium containing a calcium phosphate compound.

| | |
|---|---|
| Master batch dispersion 1 | 40 mass parts |
| Styrene monomer | 43 mass parts |
| n-butyl acrylate monomer | 23 mass parts |
| Hydrocarbon wax (Fischer-Tropsch wax, maximum endothermic peak temperature = 78° C., Mw = 750) | 9 mass parts |
| Resin charge control agent 1 (zeta potential: −57 mV) | 0.5 mass parts |
| Polyester resin (shell-forming resin: zeta potential = −27 mV) (polycondensate of terephthalic acid:isophthalic acid:propylene oxide denatured bisphenol A (2 mole adduct):ethylene oxide denatured bisphenol A (2 mole adduct) = 30:30:30:10 (mass ratio), acid value = 11 mgKOH/g, Tg =74° C., Mw = 11,000, Mn = 4000) | 5 mass parts |

These materials were heated to 65° C., and uniformly dissolved and dispersed at 5000 rpm using a TK Homomixer (Tokushukika Kogyo). 8.2 mass parts of a 70% toluene solution of the polymerization initiator 1,1,3,3-tetramethylbutyl peroxy-2-ethylhexanoate were dissolved in this to prepare a polymerizable monomer composition.

This polymerizable monomer composition was added to the aforementioned aqueous medium, and agitated for 10 minutes at 12,000 rpm in a TK homomixer at 65° C. in a $N_2$ atmosphere to granulate the polymerizable monomer composition. This was then warmed to 67° C. while being agitated with a paddle, and when the polymer conversion rate of the polymerizable monomer reached 90%, a 0.1 mol/liter aqueous sodium hydroxide solution was added to adjust the pH of the aqueous medium to 9. The temperature was raised to 80° C. at a rate of 40° C./h, and the mixture was reacted for 4 hours. After completion of the polymerization reaction, the residual monomer in the toner particles was distilled off under reduced pressure. The weight-average particle diameter of the resulting toner particles was 5.8 μm, and the D50 wt %/D50 number % was 1.15. The aqueous medium was then cooled, hydrochloric acid was added to give a pH of 1.4, and the calcium phosphate salt was dissolved by 6 hours of agitation. The toner particles were filtered out and water washed, and dried for 48 hours at 40° C. The resulting dried product was rigorously sorted with a multi-grade classifier (Nittetsu Mining Co. Elbow-Jet classifier) so that the amount of particles with a weight-average diameter of 12.7 μm or more was 0.5 mass % and the amount of particles with a number-average diameter of 4.0 μm or more was 20.0 number %, to obtain black toner particles 1 with a weight-average particle diameter (D4) of 5.8 μm. The physical properties of the black toner particles 1 and the difference in zeta potential between the azo compound and the binder resin are shown in Table 3. The zeta potential of the binder resin (styrene-n-butyl acrylate copolymer) forming the core of the toner particles was −13 mV.

Manufacturing Example

Black Toner Particles 2

Black toner particles 2 were obtained as in the manufacturing example of black toner particles 1 except that azo compound 2 was substituted for azo compound 1, and the amount of calcium phosphate was adjusted so as to obtain a weight-average particle diameter of 5.8 μm of the toner particles after completion of the reaction. The physical properties of the toner particles 2 and the difference in zeta potential between the azo compound and the binder resin are shown in Table 3.

Manufacturing Example

Black Toner Particles 3

Black toner particles 3 were obtained as in the manufacturing example of black toner particles 1 except that no azo compound 1 was added, and the amount of calcium phosphate was adjusted so as to obtain a weight-average particle diameter of 5.8 μm of the toner particles after completion of the reaction. The physical properties of the black toner particles 3 are shown in Table 3.

Manufacturing Examples

Black Toner Particles 4 to 17 and 19 to 26

Black toner particles 4 to 17 and 19 to 26 were obtained as in the manufacturing example of black toner particles 1 except that the azo compounds 3 to 16 and 17 to 24 were substituted for the azo compound 1, respectively, and the amount of calcium phosphate was adjusted so as to obtain a weight-average particle diameter of 5.8 μm of the toner particles after completion of the reaction. The physical properties of the black toner particles and the differences in zeta potential between the azo compounds and binder resins are shown in Table 3.

Manufacturing Example

Black Toner Particles 18

Black toner particles 18 were obtained as in the manufacturing example of black toner particles 1 except that no resin-based charge control agent 1 was added, and the amount of calcium phosphate was adjusted so as to obtain a weight-average particle diameter of 5.8 μm of the toner particles after completion of the reaction. The physical properties of the black toner particles 18 and the difference in zeta potential between the azo compound and the binder resin are shown in Table 3.

Manufacturing Example

Black Toner Particles 27

180 mass parts of ethyl acetate, 12 mass parts of carbon black: NIPEX 35 (Orion Engineered Carbons Co.), 0.6 mass parts of the azo compound 24 and 130 mass parts of glass beads (ϕ1 mm) were mixed, dispersed for 3 hours with an attritor (Nippon Coke and Engineering), and filtered to prepare a pigment dispersion (aj).

The following composition was dispersed for 24 hours with a ball mill to obtain a toner composition mixture.

| | |
|---|---|
| Pigment dispersion (aj) | 96.0 mass parts |
| Binder resin (Saturated polyester resin (polycondensate of propylene oxide denatured bisphenol A and phthalic acid, Tg = 75.9° C., Mw = 11,000, Mn = 4200, acid value 11), zeta potential −10 mV) | 85.0 mass parts |
| Hydrocarbon wax (Fischer-Tropsch wax, maximum endothermic peak = 80° C. in DSC measurement, Mw = 750) | 9.0 mass parts |
| Aluminum salicylate compound (BONTRON E-88, Orient Chemical Industries Co., Ltd.) | 2.0 mass parts |
| Resin-based charge control agent 1 | 0.5 mass parts |
| Ethyl acetate (solvent) | 10.0 mass parts |

The following composition was dispersed for 24 hours with a ball mill to dissolve the carboxymethyl cellulose and obtain an aqueous medium.

| | |
|---|---|
| Calcium carbonate (coated with acrylic acid copolymer) | 20.0 mass parts |
| Carboxymethyl cellulose (Cellogen BS-H, Daiichi Kogyo Seiyaku Co., Ltd.) | 0.5 mass parts |
| Ion exchange water | 99.5 mass parts |

1200 mass parts of the aqueous medium were placed in a high speed agitator (T.K. homomixer, Primix), and agitated with a moving vane at a circumferential velocity of 20 m/sec while 1000 mass parts of the toner composition mixture were added, and this was agitated for 1 minute with the temperature maintained at 25° C. to obtain a liquid suspension. The weight-average particle diameter of the resulting toner was 5.8 μm, and the D50 wt %/D50 number % was 1.12.

2200 mass parts of this liquid suspension was agitated with a Fullzone blade (Kobelco Eco-Solutions Co., Ltd.) at a circumferential velocity of 45 m/min, and the liquid temperature was maintained at 40° C. as the vapor phase on the surface of this liquid suspension was subjected to forced inspiration with a blower to initiate solvent removal. 15 minutes after the start of solvent removal, 75 mass parts of ammonia water diluted to 1% as an ionic substance were added, and 1 hour, 2 hours and 3 hours after the start of solvent removal, 25 mass parts of ammonia water were added, bringing the total added amount to 150 mass parts. The liquid temperature was maintained at 40° C. for 17 hours after the start of solvent removal to remove the solvent from the suspended particles and obtain a toner dispersion.

80 mass parts of 10 mol/l hydrochloric acid were added to 300 mass parts of the toner dispersion obtained in the solvent removal step, this was further neutralized with a 0.1 mol/l aqueous sodium hydroxide solution, and ion exchange water washing was performed 4 times by suction filtration to obtain a toner cake. The resulting toner cake was dried with a vacuum drier, and the resulting dried product was rigorously sorted with a multi-grade classifier (Nittetsu Mining Co. Elbow-Jet classifier) so that the amount of particles with a weight-average diameter of 12.7 μm or more was 0.5 wt % and the amount of particles with a number-average diameter of 4.0 μm or more was 25.0 number %, to obtain black toner particles 27 with a weight-average particle diameter (D4) of 5.8 μm. The physical properties of the black toner particles 27 and the difference in zeta potential between the azo compound and the binder resin are shown in Table 3.

Manufacturing Example

Black Toner Particles 28

Black toner particles 28 were obtained as in the manufacturing example of black toner particles 1 except that azo compound 25 was added, and the amount of calcium phosphate was adjusted so as to obtain a weight-average particle diameter of 5.8 μm of the toner particles after completion of the reaction.

Manufacturing Example

Yellow Toner Particles 1

Toner particles were manufactured as in the manufacturing example of black toner particles 1 except that the 20.0 mass parts of carbon black: NIPEX 35 (Orion Engineered Carbons Co.) were replaced with 12.5 mass parts of Pigment Yellow 155 (Clariant Co., trade name "Toner Yellow 3GP", zeta potential: −6 mV), and the amount of calcium phosphate was adjusted so as to obtain a weight-average particle diameter of 5.8 μm of the toner particles after completion of the reaction, to obtain yellow toner particles 1 with a weight-average particle diameter (D4) of 5.8 μm. The physical properties of the yellow toner particles 1 and the difference in zeta potential between the azo compound and the binder resin are shown in Table 3.

Manufacturing Example

Magenta Toner Particles 1

Toner particles were manufactured as in the manufacturing example of black toner particles 1 except that the 20.0 mass parts of carbon black: NIPEX 35 (Orion Engineered Carbons Co.) were replaced with 16.5 mass parts of Pigment Red 122 (zeta potential: 6 mV), and the amount of calcium phosphate was adjusted so as to obtain a weight-average particle diameter of 5.8 μm of the toner particles after completion of the reaction, to obtain magenta toner particles 2 with a weight-average particle diameter (D4) of 5.8 μm. The physical properties of the magenta toner particles 2, and the difference in zeta potential between the azo compound and the binder resin are shown in Table 3.

Manufacturing Example

Magenta Toner Particles 2

Toner particles were manufactured as in the manufacturing example of black toner particles 1 except that the 20.0 mass parts of carbon black: NIPEX 35 (Orion Engineered Carbons Co.) were replaced with 16.5 mass parts of Pigment Red 155 (zeta potential: 0 mV), and the amount of calcium phosphate was adjusted so as to obtain a weight-average particle diameter of 5.8 μm of the toner particles after completion of the reaction, to obtain magenta toner particles 2 with a weight-average particle diameter (D4) of 5.8 μm. The physical properties of the magenta toner particles 2 and the difference in zeta potential between the azo compound and the binder resin are shown in Table 3.

Example 1

1.5 mass parts of silica particles (RY200: Nippon Aerosil Co., Ltd.) and 0.2 mass parts of rutile titanium oxide fine powder (average primary particle diameter 30 nm) subjected to surface treatment with dimethyl silicone oil were dry mixed for 5 minutes with 100 mass parts of black toner particles 1 in a Henschel mixer (Mitsui Mining) to obtain a black toner 1. The black toner 1 was evaluated as follows. The evaluation results are shown in Table 3.

As shown in the evaluation results, good results were obtained in all the evaluations.

(Granulating Properties of Black Toner Particles)

The granulating properties of the black toner particles were investigated based on the D50 wt %/D50 number % as measured with a Coulter Counter, using the toner particle suspension after completion of the polymerization reaction in the case of the suspension polymerization method and the toner particle dispersion after removal of the solvent from the suspended particles in the case of the dissolution suspension method.

Granulating property evaluation standard (D50 wt %/D50 number %)

A: Less than 1.20. Desirable, very sharp particle distribution (no adverse effects from azo compound addition).

B: 1.20 to less than 1.28. Particle distribution somewhat broader, but at a level that causes no problems for the product (some effect from azo compound addition).

C: 1.28 or more. Particle distribution broad, at a level that causes problems for the product (large effect from azo compound addition).

(Toner Laid-On Level On Paper at Image Density 1.40)

A 10 mm×10 mm solid image for concentration measurement was output in the center of standard A4 paper (GF-0081A4: Canon Marketing Japan) using a LBP7600C printer (Canon) modified and set to give a fixing temperature of 160° C. The development contrast was adjusted so as to give an image density of 1.40 of the 10 mm×10 mm solid image for concentration measurement as measured with a Macbeth RD918 densitometer (Macbeth Co.).

The laid-on amount of unfixed toner on the paper at these settings was measured and ranked as follows.

(Evaluation Standard)

A: Less than 0.35 mg/cm$^2$. Dispersion of pigment greatly improved by addition of the azo compound, leading to a large reduction in laid-on toner on the paper.

B: 0.35 mg/cm$^2$ to less than 0.43 mg/cm$^2$. Dispersion of pigment improved by addition of the azo compound, leading to a reduction in laid-on toner on the paper.

C: 0.43 mg/cm$^2$ to less than 0.47 mg/cm$^2$. Same as without addition of azo compound, no effect on dispersion of pigment.

D: 0.47 mg/cm$^2$ or more. Dispersion of pigment made worse by addition of azo compound.

(Image Output Test)

Image evaluation was performed in different environments using a LBP7600C Canon printer. The LBP7600C is a system in which there is no cleaning member in the intermediate transfer part, and residual toner remaining after primary and secondary transfer is collected by the cleaning member of the photosensitive member. A cartridge filled with 70 g of evaluation toner was mounted on the printer's cyan station, while dummy cartridges were mounted on the others. An image output test was then performed with the development contrast adjusted to obtain an initial image density of 1.40.

The image evaluation was performed in environments of 15° C./10% RH (low-temperature, low-humidity environment, abbreviated below as LL environment) and 32.5° C./90% RH (high-temperature, high-humidity environment, abbreviated below as HH environment). In each environment, the operation of outputting images with a coverage rate of 1% was repeated, and each time the number of output sheets reached 200. The printer was left for 1 week in each of the environments. The operation of outputting 200 sheets was then repeated as described above until ultimately 4600 sheets were output, and the following evaluations were performed. The evaluation paper was standard A4 paper (GF-0081A4: Canon Marketing Japan).

(1) Evaluation of Fogging

In the image output test in the HH environment, an image having a blank part was output each time after the printer was had been left for 1 week. For all images having blank parts, the fogging concentration (%) (=Dr (%)−Ds (%)) was calculated from the difference between the whiteness (reflectance Ds (%)) of the blank part of the image having the blank part and the whiteness (average reflectance Dr (%)) of the transfer paper. Whiteness was measured with a "Reflectmeter Model TC-6DS" (Tokyo Denshoku Model TC-6DS). An amber filter was used as the filter. In the evaluation, fogging was ranked as follows for those with the worst fogging. Although A, B and C are levels that are not a problem for use, D is a level that is a problem for use.

A: Fogging concentration less than 0.3%

B: Fogging concentration 0.3% to less than 0.8%

C: Fogging concentration 0.8% to less than 1.3%

D: Fogging concentration 1.3% or more (2) Image Density Stability

The image density was measured with a color reflection densitometer (X-RITE 404A, manufactured by X-Rite Co.). In the LL environment and HH environment image output tests above, a solid image was output each time after the printer had been left for 1 week, and the density of each image was measured. In the image density results, the difference between the image with the greatest density and the one with the smallest density was determined and evaluated according to the following standard.

A: Image density difference 0.3 or less

B: Image density difference more than 0.3 to 0.5 or less

C: Image density difference more than 0.5

(3) Fine Line Reproducibility (Image Quality)

Fine line reproducibility was evaluated as a measure of image quality. After image output of 4600 sheets in the HH environment, an image of a lattice pattern with a line width of 3 pixels was printed on the entire surface of A4 paper (print area ratio 4%), and fine line reproducibility was evaluated. A line width of 3 pixels corresponds theoretically to 127 μm. The line width of the image was evaluated with a VK-8500 Microscope (Keyence Corp.). The line width was measured at five randomly selected points, the average of three points excluding the maximum and minimum values was given as d (μm), and the fine line reproducibility index L was defined as follows:

$$L(\mu m)=|127-d|.$$

L is defined as the difference between the theoretical line width of 127 μm and the line width d of the output images. Because d may be either greater or smaller than 127, the difference is defined as an absolute value. The smaller the value of L, the greater the fine line reproducibility.

(Evaluation Standard)

A: L=less than 10 μm. Excellent fine line reproducibility.

B: L=10 μm to less than 15 p.m. Slight fluctuation in fine line width observed, but fine line reproducibility does not present a problem for use.

C: L=15 μm to less than 30 μm. Obvious line thinning and scattering.

Example 2

Evaluations were performed as in Example 1 except that black toner particles 2 were substituted for black toner particles 1, to obtain black toner 2 instead of black toner 1. The evaluation results are shown in Table 3. As shown in the table, good results were obtained in all evaluations.

Comparative Example 1

Evaluations were performed as in Example 1 except that black toner particles 3 were substituted for black toner particles 1, to obtain a black toner 3 instead of the black toner 1. The evaluation results are shown in Table 3. The black toner 3 is a toner with no added azo compound. Thus, in the examples and comparative examples, those toners having evaluation results equal to or exceeding those of the black toner 3 in the toner particle granulating properties and image output tests are judged to have no ill effects from addition of the azo compound.

Examples 3 to 5

Evaluations were performed as in Example 1 except that black toner particles 4 to 6 were substituted for black toner particles 1, to obtain black toners 4 to 6 instead of black toner 1. The evaluation results are shown in Table 3.

Examples 6 and 7

Evaluations were performed as in Example 1 except that black toner particles 7 and 8 were substituted for black toner particles 1, to obtain black toners 7 and 8 instead of black toner 1. The evaluation results are shown in Table 3. The results for Example 7 were somewhat poor in all evaluations. This is believed to be because the dispersion of the pigment was somewhat poor due to the larger difference between the zeta potentials of the azo compound and binder resin. Moreover, it is thought that because the zeta potential of the azo compound is large (positive), it interacts somewhat with the resin-based charge control agent 1 and the polyester resin forming the shell of the toner particles, which have small (negative) zeta potentials, resulting in a somewhat incomplete core-shell structure and detracting from the stress resistance or the charging properties of the toner.

Comparative Example 2

Evaluations were performed as in Example 1 except that black toner particles 9 were substituted for black toner particles 1, to obtain a black toner 9 instead of the black toner 1. The evaluation results are shown in Table 3. The results were poor in all evaluations. It is thought that the dispersion of the pigment was adversely affected by the large difference in zeta potential between the azo compound and the binder resin. Moreover, it is thought that because the zeta potential of the azo compound is large (positive), it interacts somewhat with the resin-based charge control agent 1 and the polyester resin forming the shell of the toner particles, which have small (negative) zeta potentials, resulting in a poor core-shell structure and detracting from the stress resistance or the charging properties of the toner.

Examples 8 and 9

Evaluations were performed as in Example 1 except that black toner particles 10 and 11 were substituted for black toner particles 1, to obtain black toners 10 and 11 instead of the black toner 1. The evaluation results are shown in Table 3. As shown in the table, Example 9 performed somewhat poorly in all the evaluations. It is thought that the dispersion of the pigment was somewhat affected because of the larger difference in zeta potential between the azo compound and the binder resin. Moreover, it is thought that because the zeta potential of the azo compound is somewhat small, it acts on the dispersion stabilizer, detracting from the granulating properties. At the same time, it may be that the stress resistance and charging performance of the toner are adversely affected because the core-shell structure of the toner is somewhat incomplete.

Comparative Example 3

Evaluations were performed as in Example 1 except that black toner particles 12 were substituted for black toner particles 1, to obtain a black toner 12 instead of the black toner 1. The evaluation results are shown in Table 3. The results were poor in all evaluations. It is thought that the dispersion of the pigment was adversely affected by the large difference in zeta potential between the azo compound and the binder resin. Moreover, it is thought that because the azo compound has a small zeta potential, it acts somewhat on the dispersion stabilizer, detracting from the granulating properties. At the same time, it may be that the stress resistance and charging performance of the toner are adversely affected because the core-shell structure of the toner is somewhat incomplete.

Comparative Example 4

Evaluations were performed as in Example 1 except that black toner particles 13 were substituted for black toner particles 1, to obtain a black toner 13 instead of the black toner 1. The evaluation results are shown in Table 3. The results were poor in all evaluations. It is thought that because the azo compound did not have the structure of the present invention, it had extremely low adsorbability by the pigment and therefore did not affect the dispersion of the pigment. It is also thought that azo compound not adsorbed by the pigment had some effect on the other toner particles, detracting from the stress resistance and charging performance of the toner.

Examples 10 and 11

Evaluations were performed as in Example 1 except that black toner particles 14 and 15 were substituted for the black toner particles 1, to obtain black toners 14 and 15 instead of the black toner 1. The evaluation results are shown in Table 3. As shown in the table, the results for Example 11 were somewhat poor in all evaluations. It is thought that the azo compound did not have a sufficient effect on dispersion of the pigment because it had poor adsorbability by the pigment. It is also thought that azo compound not adsorbed by the pigment had some effect on the other toner particles, detracting from the stress resistance and charging performance of the toner.

Examples 12 and 13

Evaluations were performed as in Example 1 except that black toner particles 16 and 17 were substituted for the black toner particles 1, to obtain black toners 16 and 17 instead of the black toner 1. The evaluation results are shown in Table 3. As shown in the table, the results for Example 13 were somewhat poor in all evaluations. It is thought that because the acid value of the azo compound was somewhat high, it acted on the dispersion stabilizer, detracting somewhat from the granulating properties. At the same time, it may be that the stress resistance and charging performance of the toner were adversely affected because the core-shell structure of the toner was somewhat incomplete.

Example 14

Evaluations were performed as in Example 1 except that black toner particles 18 were substituted for black toner particles 1, to obtain a black toner 18 instead of the black toner 1. The evaluation results are shown in Table 3.

Examples 15 to 17

Evaluations were performed as in Example 1 except that yellow toner particles 1, magenta toner particles 1 and magenta toner particles 2 were substituted for the black toner particles 1, to obtain a yellow toner 1, magenta toner 1 and magenta toner 2 instead of the black toner 1. Granulating properties were evaluated on the basis of the following evaluation standard. The evaluation results are shown in Table 3. As shown in the table, good results were obtained in all evaluations.

(Granulating Properties of Yellow and Magenta Toner Particles)

Granulating property evaluation standard (D50 wt %/D50 number %)

A: Less than 1.30. Desirable, extremely sharp particle size distribution (no adverse effects from azo compound addition).

B: 1.30 to less than 1.35. Particle distribution somewhat broader, but at a level that causes no problems for the product (some effect from azo compound addition).

C: 1.35 or more. Particle distribution broad, at a level that causes problems for the product (large effect from azo compound addition).

Examples 18 and 19

Evaluations were performed as in Example 1 except that black toner particles 19 and 20 were substituted for the black toner particles 1. The evaluation results are shown in Table 3.

Examples 20 to 24

Evaluations were performed as in Example 1 except that black toner particles 21 to 25 were substituted for the black toner particles 1. The evaluation results are shown in Table 3. As shown in the table, good results were obtained in all evaluations.

Example 25

Evaluations were performed as in Example 1 except that black toner particles 26 were substituted for the black toner particles 1, to obtain a black toner 26 instead of the black toner 1. The evaluation results are shown in Table 3. The results are somewhat poor for all evaluations. It is thought that because the structure of the binder resin is different from that of the polymer component of the azo compound, the polymer component had rather poor affinity for the binder resin, detracting somewhat from dispersion of the pigment.

Examples 26 and 27

Evaluations were performed as in Example 1 except that black toner particles 27 and 28 were substituted for the black toner particles 1 to obtain black toners 27 and 28 instead of the black toner 1. The evaluation results are shown in Table 3. As shown in the table, good results were obtained in all evaluations.

TABLE 3

| | Toner | Toner particles | Azo compound | Absolute zeta potential difference (mV) | Azo compound adsorb-ability (%) | Granulation properties (D50 wt %/ D50 number %) | Laid-on @image density 1.40 (mg/cm$^2$) | Fogging (%) | Image density stability | Image quality (mm) |
|---|---|---|---|---|---|---|---|---|---|---|
| Ex. 1 | Black toner 1 | Black toner particles 1 | Azo compound 1 | 13 | 94 | A: 1.15 | A: 0.31 | A: 0.2 | A: 0.2 | A: 7 |
| Ex. 2 | Black toner 2 | Black toner particles 2 | Azo compound 2 | 14 | 97 | A: 1.15 | A: 0.29 | A: 0.1 | A: 0.2 | A: 6 |
| CE 1 | Black toner 3 | Black toner particles 3 | — | — | — | (A): 1.18 | (C): 0.45 | (B): 0.5 | (B): 0.5 | (B): 14 |
| Ex. 3 | Black toner 4 | Black toner particles 4 | Azo compound 3 | 13 | 48 | A: 1.18 | A: 0.34 | B: 0.3 | A: 0.3 | A: 7 |
| Ex. 4 | Black toner 5 | Black toner particles 5 | Azo compound 4 | 13 | 43 | A: 1.19 | B: 0.35 | A: 0.2 | A: 0.3 | A: 8 |
| Ex. 5 | Black toner 6 | Black toner particles 6 | Azo compound 5 | 14 | 89 | A: 1.18 | B: 0.35 | A: 0.2 | A: 0.3 | B: 10 |
| Ex. 6 | Black toner 7 | Black toner particles 7 | Azo compound 6 | 18 | 93 | A: 1.19 | A: 0.32 | A: 0.2 | A: 0.2 | A: 4 |
| Ex. 7 | Black toner 8 | Black toner particles 8 | Azo compound 7 | 25 | 92 | B: 1.20 | B: 0.36 | B: 0.4 | B: 0.4 | B: 13 |
| CE 2 | Black toner 9 | Black toner particles 9 | Azo compound 8 | 28 | 90 | B: 1.27 | D: 0.48 | D: 1.5 | C: 0.7 | C: 22 |
| Ex. 8 | Black toner 10 | Black toner particles 10 | Azo compound 9 | 18 | 88 | A: 1.19 | A: 0.33 | B: 0.3 | A: 0.3 | A: 4 |
| Ex. 9 | Black toner 11 | Black toner particles 11 | Azo compound 10 | 25 | 85 | B: 1.24 | B: 0.36 | B: 0.7 | B: 0.4 | B: 14 |
| CE 3 | Black toner 12 | Black toner particles 12 | Azo compound 11 | 33 | 83 | C: 1.35 | D: 0.50 | D: 1.4 | C: 0.6 | C: 20 |
| CE 4 | Black toner 13 | Black toner particles 13 | Azo compound 12 | 12 | 24 | C: 1.30 | C: 0.44 | D: 1.5 | C: 0.8 | C: 21 |
| Ex. 10 | Black toner 14 | Black toner particles 14 | Azo compound 13 | 3 | 70 | A: 1.19 | B: 0.36 | A: 0.2 | A: 0.3 | A: 4 |
| Ex. 11 | Black toner 15 | Black toner particles 15 | Azo compound 14 | 13 | 30 | B: 1.21 | B: 0.39 | B: 0.7 | B: 0.4 | B: 12 |
| Ex. 12 | Black toner 16 | Black toner particles 16 | Azo compound 15 | 3 | 80 | A: 1.19 | A: 0.31 | A: 0.2 | A: 0.3 | A: 7 |
| Ex. 13 | Black toner 17 | Black toner particles 17 | Azo compound 16 | 2 | 80 | B: 1.22 | B: 0.36 | B: 0.4 | B: 0.4 | B: 14 |
| Ex. 14 | Black toner 18 | Black toner particles 18 | Azo compound 1 | 17 | 97 | A: 1.18 | A: 0.29 | B: 0.3 | B: 0.4 | A: 7 |
| Ex. 15 | Yellow toner 1 | Yellow toner particles 1 | Azo compound 1 | 13 | 75 | A: 1.22 | A: 0.33 | A: 0.1 | A: 0.2 | A: 6 |
| Ex. 16 | Magenta toner 1 | Magenta toner particles 1 | Azo compound 1 | 13 | 95 | A: 1.23 | A: 0.34 | A: 0.2 | A: 0.2 | A: 6 |
| Ex. 17 | Magenta toner 2 | Magenta toner particles 2 | Azo compound 1 | 13 | 80 | A: 1.24 | A: 0.33 | A: 0.2 | A: 0.2 | A: 6 |
| Ex. 18 | Black toner 19 | Black toner particles 19 | Azo compound 17 | 14 | 88 | A: 1.18 | B: 0.36 | B: 0.3 | A: 0.3 | B: 12 |
| Ex. 19 | Black toner 20 | Black toner particles 20 | Azo compound 18 | 17 | 88 | A: 1.19 | B: 0.36 | B: 0.3 | A: 0.3 | B: 11 |
| Ex. 20 | Black toner 21 | Black toner particles 21 | Azo compound 19 | 14 | 91 | A: 1.18 | A: 0.34 | A: 0.2 | A: 0.3 | A: 9 |
| Ex. 21 | Black toner 22 | Black toner particles 22 | Azo compound 20 | 17 | 93 | A: 1.19 | A: 0.32 | A: 0.2 | A: 0.3 | A: 8 |
| Ex. 22 | Black toner 23 | Black toner particles 23 | Azo compound 21 | 10 | 91 | A: 1.19 | A: 0.34 | A: 0.2 | A: 0.3 | A: 9 |
| Ex. 23 | Black toner 24 | Black toner particles 24 | Azo compound 22 | 13 | 91 | A: 1.18 | A: 0.32 | A: 0.2 | A: 0.3 | A: 8 |
| Ex. 24 | Black toner 25 | Black toner particles 25 | Azo compound 23 | 14 | 92 | A: 1.19 | A: 0.32 | A: 0.2 | A: 0.3 | A: 7 |

TABLE 3-continued

| | Toner | Toner particles | Azo compound | Absolute zeta potential difference (mV) | Azo compound adsorb-ability (%) | Granulation properties (D50 wt %/ D50 number %) | Laid-on @image density 1.40 (mg/cm$^2$) | Fogging (%) | Image density stability | Image quality (mm) |
|---|---|---|---|---|---|---|---|---|---|---|
| Ex. 25 | Black toner 26 | Black toner particles 26 | Azo compound 24 | 8 | 94 | B: 1.20 | B: 0.38 | B: 0.4 | B: 0.4 | B: 10 |
| Ex. 26 | Black toner 27 | Black toner particles 27 | Azo compound 24 | 5 | 95 | A: 1.17 | A: 0.31 | A: 0.1 | A: 0.2 | A: 7 |
| Ex. 27 | Black toner 28 | Black toner particles 28 | Azo compound 25 | 13 | 96 | A: 1.18 | A: 0.29 | A: 0.1 | A: 0.2 | A: 8 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-044320, filed Feb. 29, 2012, which is hereby incorporated by reference herein in its entirety.

What is claimed is:

1. A toner comprising toner particles, each of which contains a binder resin, a pigment and an azo compound and manufactured in an aqueous medium by the manufacturing method of (i) or (ii) below:

(i) dispersing and granulating a polymerizable monomer composition containing a polymerizable monomer, a pigment and an azo compound in an aqueous medium, and polymerizing the polymerizable monomer contained in granulated particles to thereby produce a toner;

(ii) dissolving or dispersing a toner composition containing a binder resin, a pigment and an azo compound in an organic solvent, dispersing and granulating the resulting mixed solution in an aqueous medium, and removing the organic solvent contained in granulated particles to thereby produce a toner, wherein the pigment is at least one selected from the group consisting of Carbon black, C.I. Pigment Yellow 3, 7, 10, 12, 13, 14, 15, 17, 23, 24, 60, 62, 75, 83, 94, 95, 99, 100, 101, 104, 108, 109, 110, 111, 117, 123, 129, 138, 139, 147, 148, 150, 166, 168, 169, 177, 179, 181, 183, 185, 191:1, 191, 192, 193and 199, C.I. Pigment Red 6, 7, 48:3, 48:4, 81:1, 122, 150, 169, 177, 184, 202, 206, and 254, C.I. Pigment Violet 19, C.I. Pigment Blue 1, 7, 15, 15:1, 15:2, 15:3, 15:4, 60, 62 and 66, wherein the azo compound contains a polymer component, and the part other than the polymer component is represented by General Formula (1) below:

Formula (1)

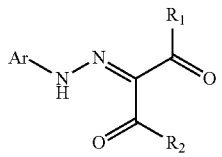

(in Formula (1), any one of $R_1$, $R_2$ and Ar is bound to the polymer component with a single bond or a linking group;

$R_1$ not bound to the polymer component represents a monovalent group selected from the group consisting of an alkyl group, phenyl group, $OR_5$ group and $NR_6R_7$ group wherein $R_5$ to $R_7$ each independently represent a hydrogen atom, alkyl group, phenyl group or aralkyl group), $R_1$, which is bound to the polymer component with a single bond or a linking group, represents a divalent group of which a hydrogen atom is removed from the corresponding monovalent group of $R_1$, and the linking group is a divalent linking group selected from the group consisting of an amide group, an ester group, a urethane group, a urea group, an alkylene group, a phenylene group, —O—, —$NR_3$— and —NHCH($CH_2$OH)$CH_2$—, wherein $R_3$ represents a hydrogen atom, alkyl group, phenyl group or aralkyl group;

$R_2$ not bound to the polymer component represents a monovalent group selected from the group consisting of an alkyl group, phenyl group, and $NR_{10}R_{11}$ group wherein $R_{10}$ and $R_{11}$ each independently represent a hydrogen atom, alkyl group, phenyl group or aralkyl group, $R_2$, which is bound to the polymer component with a single bond or a linking group, represents a divalent group of which a hydrogen atom is removed from the corresponding monovalent group of $R_2$, and the linking group is a divalent linking group selected from the group consisting of an alkylene group, a phenylene group, —O—, —$NR_8$—, —NHCOC($CH_3$)$_2$— and —NHCH($CH_2$OH)$CH_2$— wherein $R_8$ represents a hydrogen atom, alkyl group, phenyl group or aralkyl group;

Ar not bound to the polymer component represents an aryl group,

Ar, which is bound to the polymer component with a single bond or a linking group, represents a divalent group of which a hydrogen atom is removed from the corresponding aryl group, and the linking group is a divalent linking group selected from the group consisting of an amide group, an ester group, a urethane group, a urea group, an alkylene group, a phenylene group, —O—, —$NR_3$— and —NHCH($CH_2$OH)$CH_2$— wherein $R_3$ represents a hydrogen atom, alkyl group, phenyl group or aralkyl group and an absolute value of a difference in zeta potential between the binder resin and the azo compound is 25 mV or less.

2. The toner according to claim 1, wherein an adsorption rate of the azo compound on the pigment is 30% or more.

3. The toner according to claim 1, wherein the polymer component is a polymer or copolymer containing a monomer unit represented by General Formula (2) below as a structural component:

Formula (2)

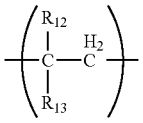

(in Formula (2), $R_{12}$ represents a hydrogen atom or an alkyl group having 1 or 2 carbon atoms, and $R_{13}$ represents a phenyl group, carboxyl group, carboxylic ester group or carboxylic amide group).

4. The toner according to claim 1, wherein a zeta potential of the azo compound is at least −10 mV but no more than 12 mV.

5. The toner according to claim 1, wherein an acid value of the azo compound is 30 mgKOH/g or less.

6. The toner according to claim 1, wherein the azo compound represented by General Formula (1) above is an azo compound represented by General Formula (4) below:

Formula (4)

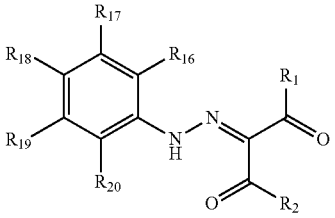

(in Formula (4), any one of $R_1$, $R_2$ and $R_{16}$ to $R_{20}$ is bound to the polymer component binds with a single bond or linking group, $R_1$ and $R_2$ and linking groups binding to $R_1$ and $R_2$ are as defined in Formula (1) above, $R_{16}$ to $R_{20}$ not bound to the polymer portion each independently represent a monovalent group selected from the group consisting of a hydrogen atom, $C_{1-6}$ alkyl group, $C_{1-6}$ alkoxy group, $COOR_{21}$ group and $CONR_{22}R_{33}$ group, and $R_{21}$ to $R_{23}$ each independently represent a hydrogen atom, $C_{1-6}$ alkyl group, phenyl group or aralkyl group;

$R_{16}$ to $R_{20}$, which is bound to the polymer component with a single bond or linking group, represents a divalent group of which a hydrogen atom is removed from the corresponding of any one of $R_{16}$ to $R_{20}$, and the linking group binding to $R_{16}$ to $R_{20}$ is a divalent linking group selected from the group consisting of an amide group, an ester group, a urethane group, a urea group, an alkylene group, a phenylene group, —O—, —NH— and —NHCH($CH_2OH$)$CH_2$—.

7. The toner according to claim 1, wherein $R_2$ in General Formula (1) above is a $NR_{10}R_{11}$ group wherein $R_{10}$ is a hydrogen atom and $R_{11}$ is a phenyl group.

8. The toner according to claim 1, wherein $R_2$ in General Formula (1) above is a $NR_{10}R_{11}$ group wherein $R_{10}$ is a hydrogen atom and $R_{11}$ is a phenyl group, of which a hydrogen atom is removed, and bound to the polymer component with a linking group.

9. The toner according to claim 1, wherein the azo compound represented by General Formula (1) above is an azo compound represented by General Formula (5) below:

Formula (5)

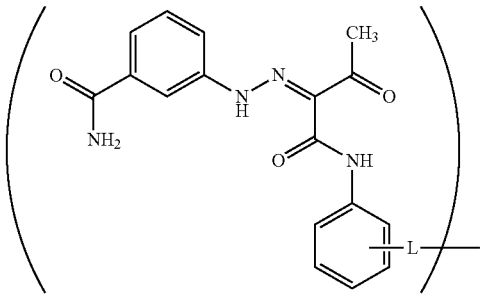

(in Formula (5), L represents a divalent linking group for linking with the polymer component).

10. The toner according to claim 1, wherein the azo compound represented by General Formula (1) above is an azo compound represented by General Formula (6) below:

Formula (6)

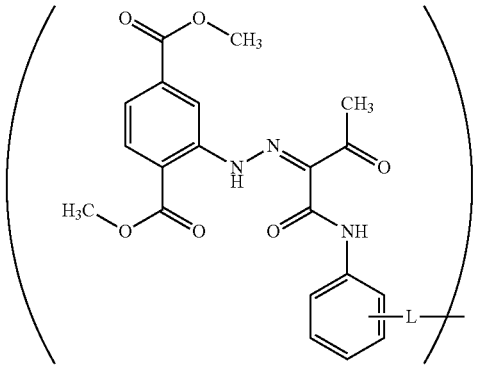

(in General Formula (6) above, L represents a divalent linking group for linking with the polymer component).

11. The toner according to claim 1, wherein the toner contains a polymer or copolymer having a sulfonic acid group, sulfonic acid salt group or sulfonic acid ester group.

12. The toner according to claim 1, wherein the pigment is at least one selected from the group consisting of Carbon black, C.I. Pigment Yellow 185, C.I. Pigment Red 122, 150, and C.I. Pigment Violet 19.

* * * * *